US007198571B2

(12) United States Patent
LeMay et al.

(10) Patent No.: US 7,198,571 B2
(45) Date of Patent: Apr. 3, 2007

(54) ROOM KEY BASED IN-ROOM PLAYER TRACKING

(75) Inventors: Steven G. LeMay, Reno, NV (US); Jamal Benbrahim, Reno, NV (US)

(73) Assignee: IGT, Reno, NV (US)

( * ) Notice: Subject to any disclaimer, the term of this patent is extended or adjusted under 35 U.S.C. 154(b) by 222 days.

(21) Appl. No.: 10/100,205

(22) Filed: Mar. 15, 2002

(65) Prior Publication Data

US 2003/0176218 A1 Sep. 18, 2003

(51) Int. Cl.
*A63F 9/24* (2006.01)

(52) U.S. Cl. ..... 463/25; 463/29

(58) Field of Classification Search ..... 463/25, 463/29; 263/25, 29
See application file for complete search history.

(56) References Cited

U.S. PATENT DOCUMENTS

| | | | | |
|---|---|---|---|---|
| 4,335,809 A | | 6/1982 | Wain | |
| 4,856,787 A | | 8/1989 | Itkis | |
| 5,326,104 A | * | 7/1994 | Pease et al. | 463/18 |
| 5,586,936 A | * | 12/1996 | Bennett et al. | 463/25 |
| 5,643,086 A | | 7/1997 | Alcorn et al. | 463/29 |
| 5,761,647 A | | 6/1998 | Boushy | 705/10 |
| 5,762,552 A | | 6/1998 | Vuong et al. | |
| 5,768,382 A | | 6/1998 | Schneier et al. | 380/23 |
| 5,770,533 A | | 6/1998 | Franchi | 463/42 |
| 5,779,545 A | | 7/1998 | Berg et al. | 463/22 |
| 5,836,817 A | | 11/1998 | Acres et al. | 463/26 |
| 5,851,149 A | * | 12/1998 | Xidos et al. | 463/42 |
| 5,999,808 A | | 12/1999 | LaDue | 455/412 |
| 6,001,016 A | * | 12/1999 | Walker et al. | 463/42 |
| 6,048,269 A | | 4/2000 | Burns et al. | 463/25 |
| 6,099,408 A | | 8/2000 | Schneier et al. | 463/29 |
| 6,104,815 A | | 8/2000 | Alcorn et al. | 380/251 |
| 6,106,396 A | | 8/2000 | Alcorn et al. | 463/29 |
| 6,135,887 A | | 10/2000 | Pease et al. | |
| 6,149,522 A | | 11/2000 | Alcorn et al. | 463/29 |
| 6,178,510 B1 | | 1/2001 | O'Connor et al. | 713/201 |
| 6,264,561 B1 | | 7/2001 | Saffari et al. | |
| 6,270,410 B1 | | 8/2001 | DeMar et al. | 463/20 |

(Continued)

FOREIGN PATENT DOCUMENTS

EP 1231577 8/2002

(Continued)

OTHER PUBLICATIONS

Fey, Slot Machines, A Pictorial History of the First 100 Years, Liberty Belle Books, 1983, p. 125.*

(Continued)

*Primary Examiner*—Corbett B. Coburn
(74) *Attorney, Agent, or Firm*—Beyer Weaver LLP

(57) ABSTRACT

A disclosed authentication instrument is used to authorize various services at a hotel-casino complex, such as but not limited to in-room gaming, in-room sports wagering, room access, safe access, mini-bar access, Electronic Fund Transfers (EFT), player tracking services and in-room entertainment services (e.g., video games and movie channels). A smart card, an electronic token and a magnetic striped card are examples of hardware that may be used as authentication instruments. For in-room gaming, the authentication instrument may be used to authorize, in a secure and legal manner, in-room game play sessions on an entertainment terminal connected to a remote gaming machine.

18 Claims, 8 Drawing Sheets

U.S. PATENT DOCUMENTS

| | | | | |
|---|---|---|---|---|
| 6,285,868 | B1 | 9/2001 | LaDue | 455/410 |
| 6,409,602 | B1 | 6/2002 | Wiltshire et al. | 463/42 |
| 6,505,772 | B1 * | 1/2003 | Mollett et al. | 235/379 |
| 6,508,709 | B1 * | 1/2003 | Karmarkar | 463/42 |
| 6,645,077 | B2 | 11/2003 | Rowe | |

FOREIGN PATENT DOCUMENTS

| | | |
|---|---|---|
| GB | 2 151 054 | 7/1985 |
| WO | WO 95/24689 | 9/1995 |
| WO | WO 96/00950 | 1/1996 |
| WO | WO 99/01188 | 1/1999 |
| WO | WO 02/055163 | 7/2002 |
| WO | WO03/019486 | 3/2003 |

OTHER PUBLICATIONS

Hotel Online, Hilton New York Towers to Install Smartcard Electronic Door Locks, www.hotel-online.com, press release Jul. 1998.

* cited by examiner

ROOM KEY BASED IN-ROOM PLAYER TRACKING

BACKGROUND OF THE INVENTION

This invention relates to gaming machines such as video slot machines and video poker machines. More particularly, the present invention relates to methods and apparatus for providing remote gaming extensions to gaming machines.

Typically, utilizing a master gaming controller, a gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to control input devices, including bill validators and coin acceptors, to accept money into the gaming machine and recognize user inputs from devices, including touch screens and button pads, to determine the wager amount and initiate game play. After game play has been initiated, the gaming machine determines a game outcome, presents the game outcome to the player and may dispense an award of some type depending on the outcome of the game.

As technology in the gaming industry progresses, the traditional mechanically driven reel slot machines are being replaced with electronic counterparts having CRT, LCD video displays or the like and gaming machines such as video slot machines and video poker machines are becoming increasingly popular. Part of the reason for their increased popularity is the nearly endless variety of games that can be implemented on gaming machines utilizing advanced electronic technology. In some cases, newer gaming machines are utilizing computing architectures developed for personal computers. These video/electronic gaming advancements enable the operation of more complex games, which would not otherwise be possible on mechanical-driven gaming machines and allow the capabilities of the gaming machine to evolve with advances in the personal computing industry.

To implement the gaming features described above on a gaming machine, a number of requirements unique to the gaming industry must be considered. The gaming machine on the casino floor is a highly regulated device. It is licensed, monitored, taxed and serviced. Typically, within a geographic area allowing gaming, i.e. a gaming jurisdiction, a governing entity is chartered with regulating the games played in the gaming jurisdiction to insure fairness and to prevent cheating. For instance, in many gaming jurisdictions, there are stringent regulatory restrictions for gaming machines requiring a time consuming approval process of 1) new gaming hardware, 2) new gaming software and 3) any software modifications to gaming software used on gaming machines.

Besides regulating gaming hardware and software, a gaming jurisdiction may regulate many other aspects of gaming including where games of chance are played (e.g. casinos, stores, restaurants and other venues), who may participate in game play (e.g. enforcing age restrictions) and where regulated gaming machines may be located (e.g. particular areas of a casino). To obtain an operating license, a casino is required to adhere to the rules and regulations of the gaming jurisdiction in which it is located. Further, a licensed casino that fails to adhere to local gaming regulations may have its operating license revoked. To enforce the legal requirements of gambling in a particular jurisdiction, such as enforcing age restrictions, casino operators typically use visual surveillance, such as cameras, and security personnel.

Currently, there is some desire by both game players and casino operators to expand game playing opportunities on gaming machines beyond the traditional casino floor area. For example, there have been attempts to place gaming machines into hotel rooms. All of these attempts have failed. A major factor in the failure of in-room gaming was the control of under-age players, i.e. preventing underage persons from gambling or participating in the gaming experience. Thus, in most jurisdictions there are laws against in-room game play.

In view of the above, it would be desirable to provide methods and apparatus for extending the opportunities for playing regulated gaming machine beyond traditional casino floor locations where gaming machines are generally located.

SUMMARY OF THE INVENTION

This invention addresses the needs indicated above by providing apparatus and methods for generating in-room gaming services. In one element of the present invention, an authentication instrument is used to authorize various services at hotel-casino complex, such as but not limited to in-room gaming, in-room sports wagering, room access, safe access, mini-bar access, Electronic Fund Transfers (EFT), player tracking services and in-room entertainment services (e.g., video games and movie channels). A smart card, an electronic token and a magnetic striped card are examples of hardware that may be used as authentication instruments. For in-room gaming, the authentication instrument may be used to authorize, in a secure and legal manner, in-room game play sessions on an entertainment terminal connected to a remote gaming machine.

One aspect of the present invention provides a method of providing a game of chance. The method may be generally characterized as comprising: i) in response to reading authentication instrument information from an authentication instrument in a door access device, granting access to a room; ii) in response to reading authentication instrument information from the authentication instrument in an entertainment terminal, initiating a game play session on the entertainment terminal where the game play session comprises playing at least one game of chance using the entertainment terminal; iii) establishing communications between the entertainment terminal and the gaming machine where the gaming machine is located outside of the room; iv) initiating the game of chance using an input device connected to the entertainment terminal; v) generating a game outcome on the gaming machine; and vi) displaying the game outcome for the game of chance generated on the gaming machine on the entertainment terminal where the game of chance may be selected from the group consisting of slot games, poker, pachinko, multiple hand poker games, pai-gow poker, blackjack, keno, bingo, roulette, craps and card game.

In particular embodiments, the authentication instrument may be selected from the group consisting of a smart card, a magnetic striped card, an electronic token, a cell phone and a personal digital assistant. The authentication instrument information may be read in the door access device from the authentication instrument using a magnetic striped card reader, a smart card reader, an electronic token acceptor and a wireless interface. Further, the authentication instrument information may be read in the entertainment terminal from the authentication instrument using a magnetic striped card reader, a smart card reader, an electronic token acceptor and a wireless interface. The authentication instrument information stored on the authentication instrument may be a combination of information selected from the group consisting of 1) an authorization number that is used to approve the game play on the entertainment terminal, 2) a transaction number that is used for all games of chance initiated using the authentication instrument, 3) a betting limit, 4) a Personal Identification Number, 5) patron identification information, 6) player tracking information, 7) an expiration date, 8) a magnetic combination that is used to gain access to an entertainment terminal, 9) credits of indicia, 10) promotional credits used only for wagers in the game of chance, 11) one or more player preferences used to configure a gaming machine, 12) one or more encryption keys, 13) an authentication instrument identification number, 14) one or more gaming machine serial numbers, 15) biometric information, 16) an authorization number that is used to authorize sports wagering on the entertainment terminal, 18) an authorization number that is used to configure the authentication instrument to authorize a movie to be displayed on the entertainment terminal, 19) an authorization number that is used to configure the authentication instrument to authorize a video game of skill to be played on the entertainment terminal, 20) a magnetic combination that is used by a door access device to unlock a door, 21) a time and a date when the authentication instrument was issued and 22) a location where the authorization instrument was issued.

In other embodiments, the method may comprise one or more of the following: a) sending a message requesting an approval for the game play session to an authentication server; and receiving the approval for the game play session from the authorization server, b) sending a message requesting an authorization for the game play session to an authentication server; receiving a rejection for the game play session from the authorization server; and terminating the game play session, c) in response to reading authentication instrument information from the authentication instrument in the entertainment terminal, using the authentication information to determine a list of services available on the entertainment terminal; and displaying a menu of the determined services on the entertainment terminal, d) storing game play session information to a non-volatile memory device located on the entertainment terminal, e) receiving a wager for the game of chance, f) displaying a bonus game on the entertainment terminal, g) detecting the authentication instrument being removed from an authentication port in the entertainment terminal; and terminating the game play session, h) receiving an input signal indicating a player dispute; and contacting a remote attendant station, i) displaying game play history information to the entertainment terminal where the game play history information is used to resolve the dispute, j) initiating a player tracking session for the games of chance played on the entertainment terminal and k) configuring the entertainment terminal using commands transmitted from a remote device.

Another aspect of the present invention provides a method of issuing an authentication instrument used for at least granting room access privileges and granting gaming privileges. The method may be generally characterized as including: 1) validating an identity of a patron to receive the authentication instrument, 2) determining the room access privileges where the room access privileges comprise at least granting access to a room with an entertainment terminal that is configured to receive inputs used to play a game of chance and that is configured to display the outcome of the game of chance; 3) configuring the authentication instrument to grant the determined room access privileges; 4) determining gaming privileges where the gaming privileges comprise at least: i) allowing the entertainment terminal to be used to play the game of chance or ii) preventing the entertainment terminal from being used to play the game of chance; 5) configuring the authentication instrument to grant the determined gaming privileges; 6) storing a configuration of the authentication instrument to an authentication server where the configuration of the authentication instrument is a combination of authentication instrument information; and 7) issuing the authentication instrument to the patron where the game of chance is selected from the group consisting of slot games, poker, pachinko, multiple hand poker games, pai-gow poker, black jack, keno, bingo, roulette, craps and card game.

In particular embodiments, the room access privileges to the room may be granted based upon a fee, a room price, a customer history and combinations thereof. Whereas, the gaming privileges may be granted based upon a room price, a customer history, ages of patrons that have access to the room and combinations thereof. The authentication instrument may be selected from the group consisting of a smart card, a magnetic striped card, an electronic token, a cell phone and a personal digital assistant. Further, the combination of authentication instrument information is selected from the group consisting of 1) an authorization number that is used to approve the game play on the entertainment terminal, 2) a transaction number that is used for all games of chance initiated using the authentication instrument, 3) a betting limit, 4) a Personal Identification Number, 5) patron identification information, 6) player tracking information, 7) an expiration date, 8) a magnetic combination that is used to gain access to an entertainment terminal, 9) credits of indicia, 10) promotional credits used only for wagers in the game of chance, 11) one or more player preferences used to configure a gaming machine, 12) one or more encryption keys, 13) an authentication instrument identification number, 14) one or more gaming machine serial numbers, 15) biometric information, 16) an authorization number that is used to authorize sports wagering on the entertainment terminal, 18) an authorization number that is used to configure the authentication instrument to authorize a movie to be displayed on the entertainment terminal, 19) an authorization number that is used to configure the authentication instrument to authorize a video game of skill to be played on the entertainment terminal, 20) a magnetic combination that is used by a door access device to unlock a door, 21) a time and a date when the authentication instrument was issued and 22) a location where the authorization instrument was issued.

In other embodiments, the method may comprise one or more of the following: a) determining entertainment privileges where the entertainment privileges comprise at least: i) allowing the entertainment terminal to be used to play video games, ii) allowing the entertainment terminal to be used to display one or more premium movie channels and iii) allowing the entertainment terminal to be use for Internet access; and configuring the authentication instrument to grant the determined entertainment privileges where the entertainment privileges may be granted based upon a fee, a room price, a customer history and combinations thereof, b) receiving the authentication instrument from the patron; and configuring the authentication instrument provided by the patron, c) reading information from the authentication instrument provided by the patron, d) determining player tracking privileges for the authentication instrument where the player tracking privileges allow the authentication instrument to be used as a player tracking card, communicating with a player tracking server; and configuring the authentication instrument to grant the player tracking privileges, e) determining cashless system privileges for the authentication instrument where the cashless system privileges allow the authentication instrument to be used to store credits used as a wager for the game of chance; communicating with a cashless system server; and configuring the authentication instrument to store the credits and f) receiving a payment for the credits stored on the authentication instrument.

Yet another aspect of the present invention provides in a gaming machine, a method of generating a game play session on an entertainment terminal in communication with the gaming machine via a network. The method may be generally characterized as comprising: 1) establishing communications with the entertainment terminal; 2) receiving from the entertainment terminal authentication instrument information read from an authentication instrument; 3) requesting approval for the game play session from an authentication server using the authentication information received from the entertainment terminal; 4) receiving an input signal to initiate a game of chance from the entertainment terminal; 5) generating the game outcome for the game of chance; and 6) displaying the game outcome for the game of chance on the entertainment terminal where the game of chance may be selected from the group consisting of slot games, poker, pachinko, multiple hand poker games, pai-gow poker, black jack, keno, bingo, roulette, craps and card game.

In particular embodiments, the authentication instrument information may be read from the authentication instrument using a magnetic striped card reader, a smart card reader, an electronic token acceptor and a wireless interface. In addition, the authentication instrument may be selected from the group consisting of a smart card, a magnetic striped card, an electronic token, a cell phone and a personal digital assistant. Further, the authentication instrument information received from the entertainment terminal may be a combination of information selected from the group consisting of 1) an authorization number that is used to grant or deny access to the game of chance on the entertainment terminal, 2) a transaction number that is used for all games of chance initiated using the authentication instrument, 3) a betting limit, 4) a Personal Identification Number, 5) patron identification information, 6) player tracking information, 7) an expiration date, 8) a magnetic combination that is used to gain access to an entertainment terminal, 9) credits of indicia, 10) promotional credits used only for wagers in the game of chance, 11) one or more player preferences used to configure the gaming machine, 12) one or more encryption keys, 13) an authentication instrument identification number, 14) one or more gaming machine serial numbers, 15) biometric information, 16) a time and a date when the authentication instrument was issued and 17) a location where the authentication instrument was issued.

In other embodiments, the method may comprise one or more of the following: a) receiving credit information from the entertainment terminal; and establishing credits on the gaming machine, b) contacting a cashless system server to validate the credit, c) receiving player tracking information from the entertainment terminal; d) contacting a player tracking system server; and establishing a player tracking session on the gaming machine, e) receiving a message approving the game play session from the authentication server, f) receiving a message disapproving the game play session from the authentication server; and terminating the game play session, g) receiving a request for game history information from a remote attendant station; and displaying game play history information to a remote display, h) configuring the entertainment terminal to enable the game play session, i) storing game play history information and j) when a betting limit is exceeded, stopping the game play session.

Another aspect of the present invention provides in an authentication server that stores configuration information for a plurality of authentication instruments, a method of authorizing authentication instrument transactions on an entertainment terminal in communication with a gaming machine. The method may be generally characterized as comprising: 1) receiving a transaction request message for an authentication instrument transaction from at least one of the gaming machine and the entertainment terminal where the request message contains authentication instrument information read from an authentication instrument; 2) identifying the authentication instrument using information stored in an authentication database; 3) comparing authentication instrument information read from the authentication instrument with information stored in the authentication database; 4) approving or rejecting the authentication instrument transaction; and 5) sending a reply message at least one of the gaming machine and the entertainment terminal indicating the authentication instrument transaction has been approved or rejected where at least one of the authentication instrument transactions is for a game play session on the entertainment terminal where the game play session comprises the play of one or more games of chance selected from the group consisting of slot games, poker, pachinko, multiple hand poker games, pai-gow poker, black jack, keno, bingo, roulette, craps and card game. In one embodiment, the authentication instrument transaction may be for a sports wagering session on the entertainment terminal.

In particular embodiments, the authentication instrument information may be read from the authentication instrument using a magnetic striped card reader, a smart card reader, an electronic token acceptor and a wireless interface. Further, the authentication instrument is selected from the group consisting of a smart card, a magnetic striped card, an electronic token, a cell phone and a personal digital assistant. In addition, the authentication instrument information read from the authentication instrument may be a combination of information selected from the group consisting of 1) an authorization number that is used to approve the game play on the entertainment terminal, 2) a transaction number that is used for all games of chance initiated using the authentication instrument, 3) a betting limit, 4) a Personal Identification Number, 5) patron identification information, 6) player tracking information, 7) an expiration date, 8) a magnetic combination that is used to gain access to an entertainment terminal, 9) credits of indicia, 10) promotional credits used only for wagers in the game of chance, 11) one or more player preferences used to configure a gaming machine, 12) one or more encryption keys, 13) an authentication instrument identification number, 14) one or more gaming machine serial numbers, 15) biometric information, 16) an authorization number that is used to authorize sports wagering on the entertainment terminal, 18) an authorization number that is used to configure the authentication instrument to authorize a movie to be displayed on the entertainment terminal, 19) an authorization number that is used to configure the authentication instrument to authorize a video game of skill to be played on the entertainment terminal, 20) a magnetic combination that is used by a door access device to unlock a door, 21) a time and a date when the authentication instrument was issued and 22) a location where the authorization instrument was issued.

In other embodiments, the method may comprise one or more of the following: a) when the game play session is approved, remotely configuring the entertainment terminal to provide the game play session, b) when the game play session is approved, remotely configuring the gaming machine to provide the game play session, c) prior to receiving the transaction request message, receiving a request to issue the authentication instrument; generating authentication instrument information that is stored on the authentication instrument; the authentication instrument to a device used to store information to authentication instruments; and storing the generated authentication instrument information to the authentication database where the authentication instrument information is at least a magnetic combination used with a door access device and gaming privilege information used to approve a game play session on the entertainment terminal and e) generating a record of the authentication instrument transaction and storing a record of the authentication instrument transaction.

Another aspect of the present invention provides an entertainment terminal for playing a game of chance. The entertainment terminal may be generally characterized as comprising: 1) a communication interface; 2) a display screen; 3) one or more input mechanisms, 3) a device designed to read authentication instrument information from an authentication instrument; and 4) a microprocessor configured i) to present the game of chance on the display screen using instructions received via the communication interface from a master gaming controller located on a gaming machine, ii) to send information from input signals generated from the one or more input mechanisms used to play the game of chance to the master gaming controller via the communication interface and iii) to grant or deny access to the game of chance using the authentication instrument information read from the authentication instrument where the game of chance is selected from the group consisting of slot games, poker, pachinko, multiple hand poker games, pai-gow poker, black jack, keno, bingo, roulette, craps and card game.

In particular embodiments, the authentication instrument may be selected from the group consisting of a smart card, a magnetic striped card, an electronic token, a cell phone and a personal digital assistant. The device designed to read authentication instrument information from an authentication instrument may be selected from the group consisting of a magnetic striped card reader, a smart card reader, an electronic token acceptor and a wireless interface. The microprocessor may be configured to provide one of more of video games, movie channels, Internet access and sports wagering on the entertainment terminal. The microprocessor may also be designed to receive commands from a remote device used to configure the entertainment terminal. In addition, the entertainment terminal may include a nonvolatile memory used to store a game play history for games of chance played on the entertainment terminal Another aspect of the present invention may comprise a gaming machine with an entertainment terminal used as a remote gaming extension. The gaming machine may be characterized as comprising: 1) a master gaming controller designed or configured i) to generate game outcomes for one or more games of chance and ii) to present remotely the game outcomes for the one or more games of chance on an entertainment terminal, 2) a first cabinet enclosing the master gaming controller; and 3) the entertainment terminal comprising: a) a communication interface; b) a display screen; c) one or more input mechanisms; d) a device designed to read authentication instrument information from an authentication instrument; and e) a microprocessor configured i) to present the game of chance on the display screen using instructions received via the communication interface from the master gaming controller, ii) to send information from input signals generated from the one or more input mechanisms used to play the game of chance to the master gaming controller via the communication interface; and f) a second cabinet enclosing at least the communication interface, the microprocessor and the device designed to read information from the authentication instrument where the master gaming controller is designed or configured to approve or reject access to the game of chance on the entertainment terminal using the information read from the authentication instrument The gaming machine may also include a non-volatile memory in the first cabinet used to store a game play history for games of chance played on the entertainment terminal.

Yet another aspect of the present invention provides an authentication server used to validate authentication instrument. The authentication server may be generally characterized as comprising: 1) a communication interface allowing the authorization server to communicate with (a) one or more configuration devices used to configure at least room access privileges and in-room gaming privileges on authentication instruments and (b) one or more devices with interfaces designed to read information stored on the authentication instruments; 2) an authentication database storing authentication instrument information for each authentication instrument configured using the configuration devices; and 3) a processor configured or designed to (i) receive an authentication transaction requests including authentication instrument information via the communication interface from the one or more devices with interfaces designed to read information stored on the authentication instruments (ii) validate the authentication instrument information by at least comparing the authentication instrument information received in the authentication transaction request with the authentication instrument information stored in the authentication database, and (iii) approve or reject the authentication transaction requests where at least one of the authentication transaction requests is a request to approve a game play session on an entertainment terminal. where the game play session comprises the play of one or more games of chance selected from the group consisting of slot games, poker, pachinko, multiple hand poker games, pai-gow poker, black jack, keno, bingo, roulette, craps and card game. In particular embodiments, the authentication request may be a request to provide a movie, to provide a video game, to provide a sports wagering session and to provide Internet access. Further, the processor may be designed to remotely configure one or more of the devices with interfaces designed to read information stored on the authentication instruments.

In particular embodiments, the authentication instrument may be selected from the group consisting of a smart card, a magnetic striped card, an electronic token, a cell phone and a personal digital assistant. Further, the authentication instrument may store a combination of authentication instrument information selected from the group consisting of 1) an authorization number that is used to approve the game play on the entertainment terminal, 2) a transaction number that is used for all games of chance initiated using the authentication instrument, 3) a betting limit, 4) a Personal Identification Number, 5) patron identification information, 6)

player tracking information, 7) an expiration date, 8) a magnetic combination that is used to gain access to an entertainment terminal, 9) credits of indicia, 10) promotional credits used only for wagers in the game of chance, 11) one or more player preferences used to configure a gaming machine, 12) one or more encryption keys, 13) an authentication instrument identification number, 14) one or more gaming machine serial numbers, 15) biometric information, 16) an authorization number that is used to authorize sports wagering on the entertainment terminal, 18) an authorization number that is used to configure the authentication instrument to authorize a movie to be displayed on the entertainment terminal, 19) an authorization number that is used to configure the authentication instrument to authorize a video game of skill to be played on the entertainment terminal, 20) a magnetic combination that is used by a door access device to unlock a door, 21) a time and a date when the authentication instrument was issued and 22) a location where the authorization instrument was issued.

Another aspect of the invention pertains to computer program products including a machine-readable medium on which is stored program instructions for implementing any of the methods described above. Any of the methods of this invention may be represented as program instructions and/or data structures, databases, etc. that can be provided on such computer readable media.

These and other features of the present invention will be presented in more detail in the following detailed description of the invention and the associated figures.

DESCRIPTION OF THE PREFERRED EMBODIMENTS

In the present invention, apparatus and methods for providing in-room gaming services are described. One element of the invention is an authentication instrument that may be used to authorize various services, such as but not limited to in-room gaming, room access, safe access, mini-bar access, Electronic Fund Transfers (EFT), player tracking services and in-room entertainment services (e.g., video games and movie channels). A smart card, an electronic token and a magnetic striped card are examples of hardware that may be used as authentication instruments of the present invention. For in-room gaming, the authentication instrument may be used to authorize, in a secure and legal manner, in-room game play sessions on an entertainment terminal connected to a remote gaming machine.

The entertainment terminal used for in-room gaming may be connected to an authentication system. The authentication system may include an authentication server that may be used for one or more of the following: 1) to store information regarding authentication instruments, 2) authenticate the authentication instruments, 3) approve transactions initiated through the use of an authentication instrument and 4) configure devices that use the authentication instruments. In one embodiment, to start an in-room game play session, the authentication instrument may be inserted into an authentication port that accepts the authentication instrument and the entertainment terminal may read information from the authentication instrument. As an example, a magnetic striped card may be inserted into a card slot (i.e., an authentication port) for a card reader installed on the entertainment terminal. The entertainment terminal may use the card reader to read information from the authentication instrument. After reading the authentication instrument information, the entertainment terminal may contact the authentication server to validate the information read from the authentication instrument and start the in-room game play session. Details of methods and hardware for providing in-room game play services and other entertainment services using the authentication instruments of the present invention are described as follows.

Figure 1A:
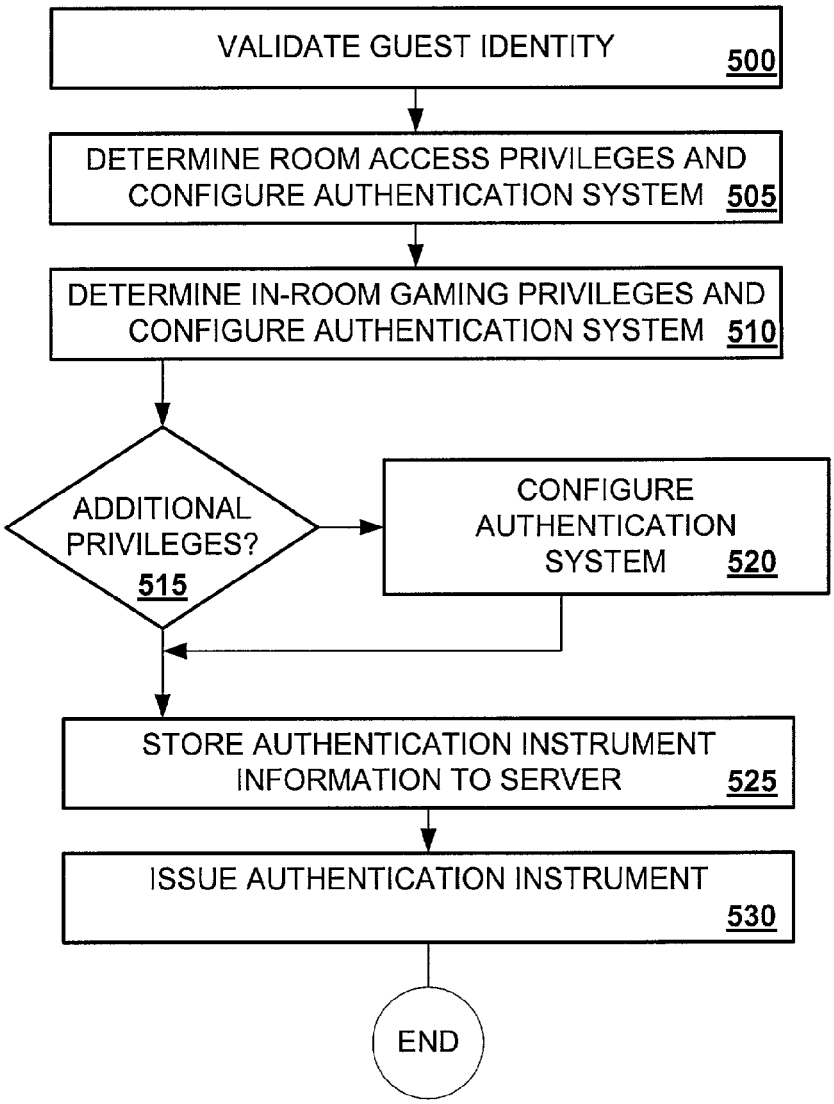
FIG. 1A is a flow chart depicting a method of providing an authentication instrument for in-room gaming access.
Figure 1B:
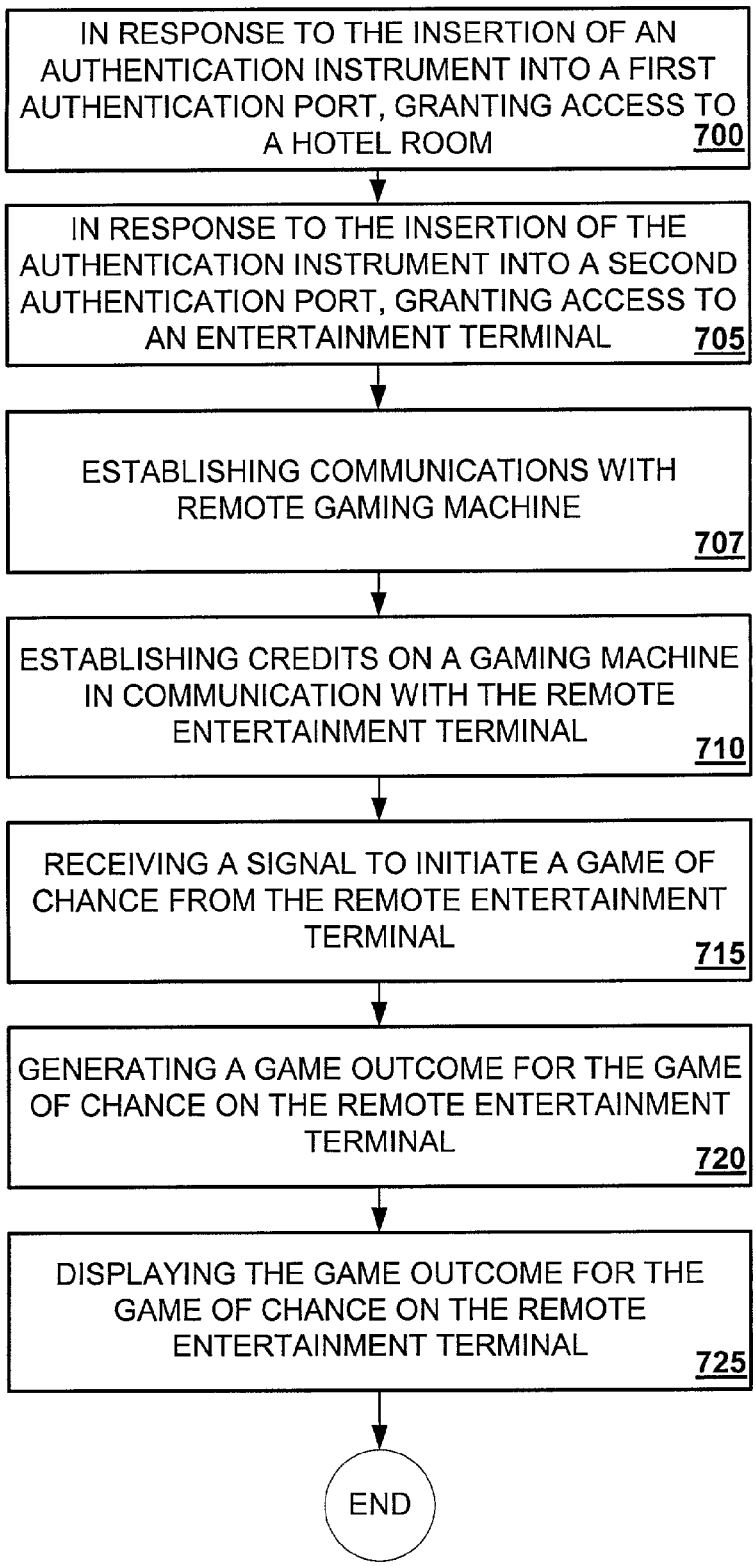
FIG. 1B is a flow chart depicting a method of providing in-room gaming using an authentication instrument of the present invention.
Figure 1C:
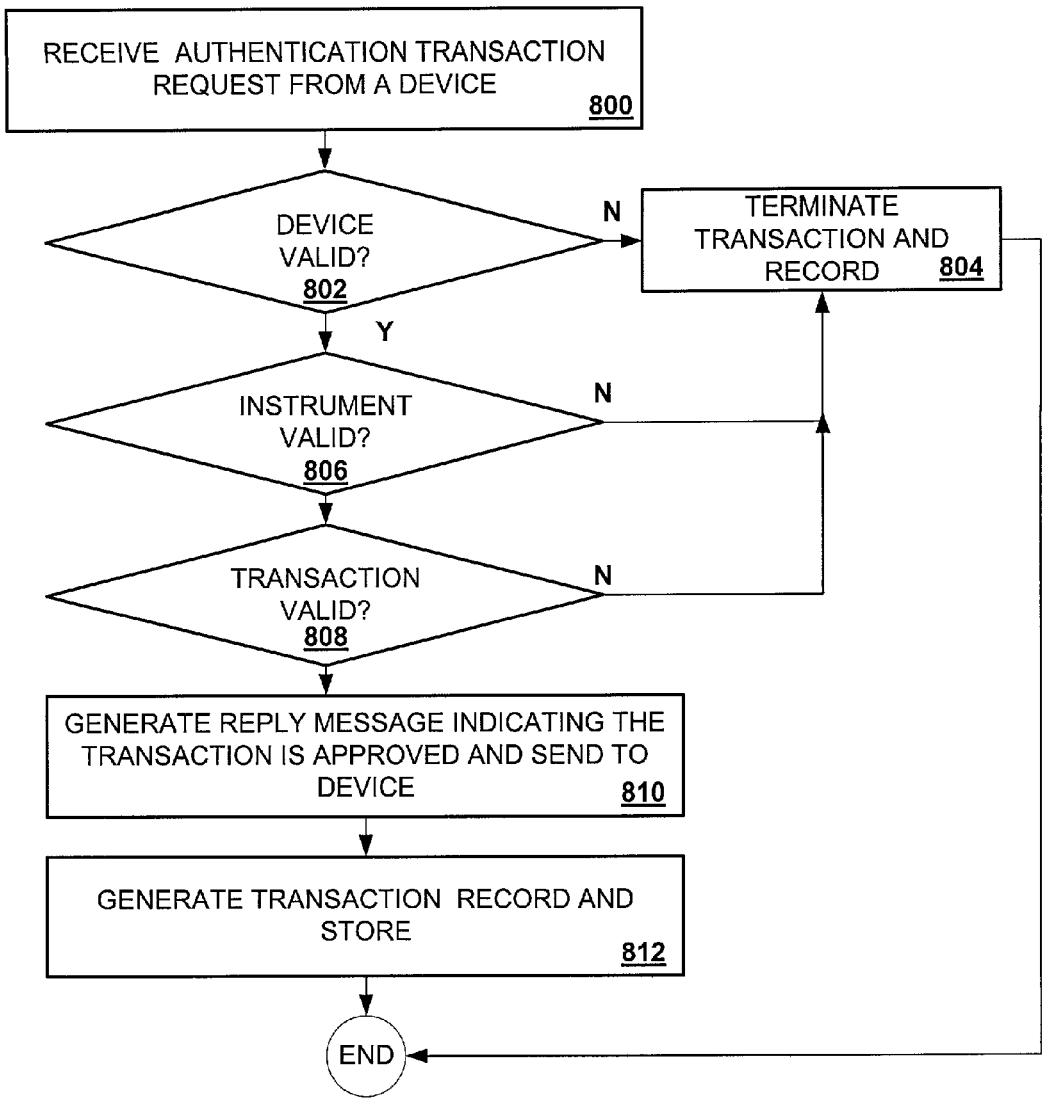
FIG. 1C is a flow chart depicting a method of providing authentication instrument transaction.
Figure 2:
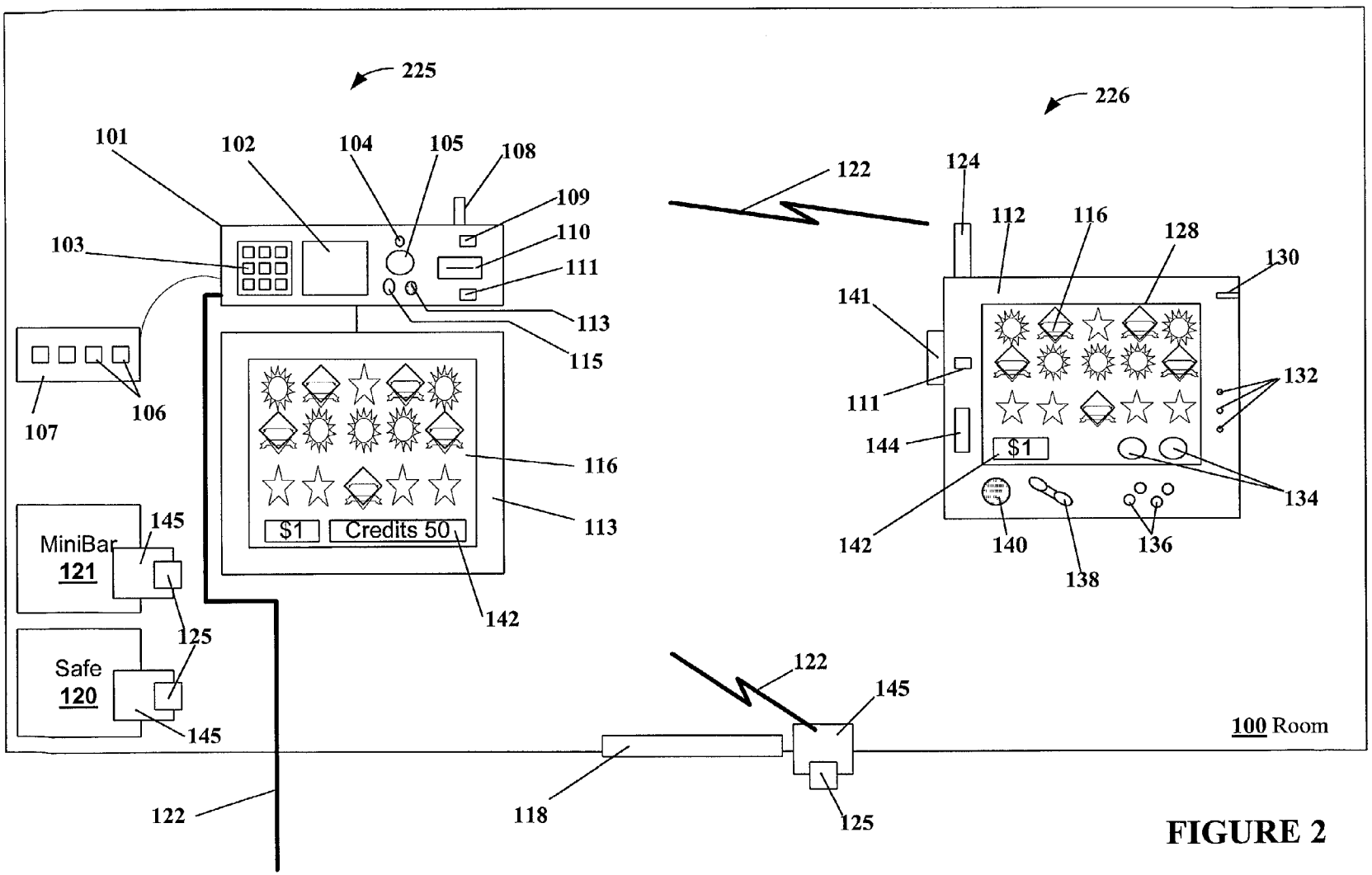
FIG. 2 is a block diagram of a hotel room with a number of devices that are used in an authentication system of the present invention.
Figure 3:
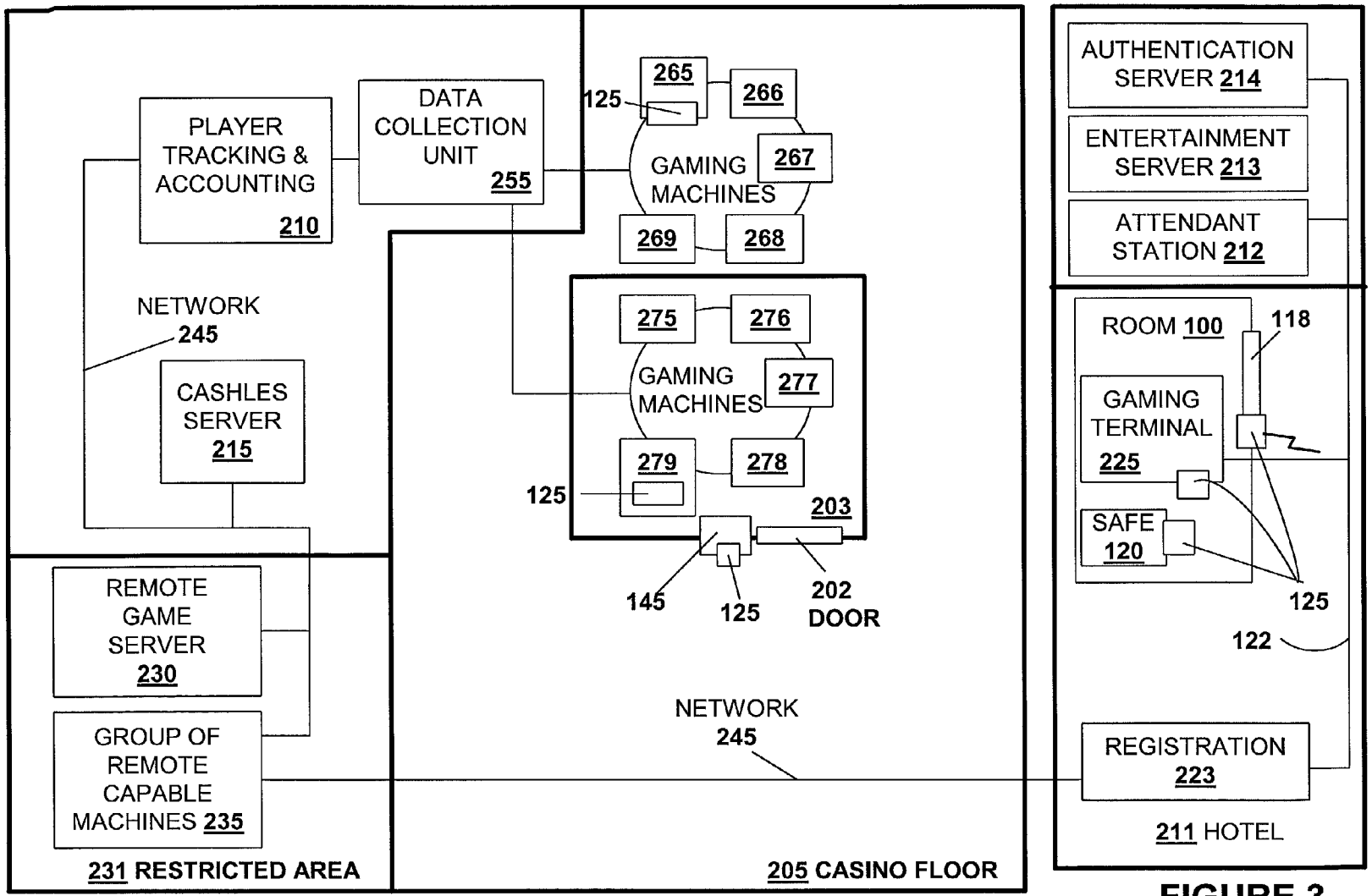
FIG. 3 is a block diagram of hotel-casino complex with a plurality of devices that use authentication instruments of the present invention.
Figure 4:
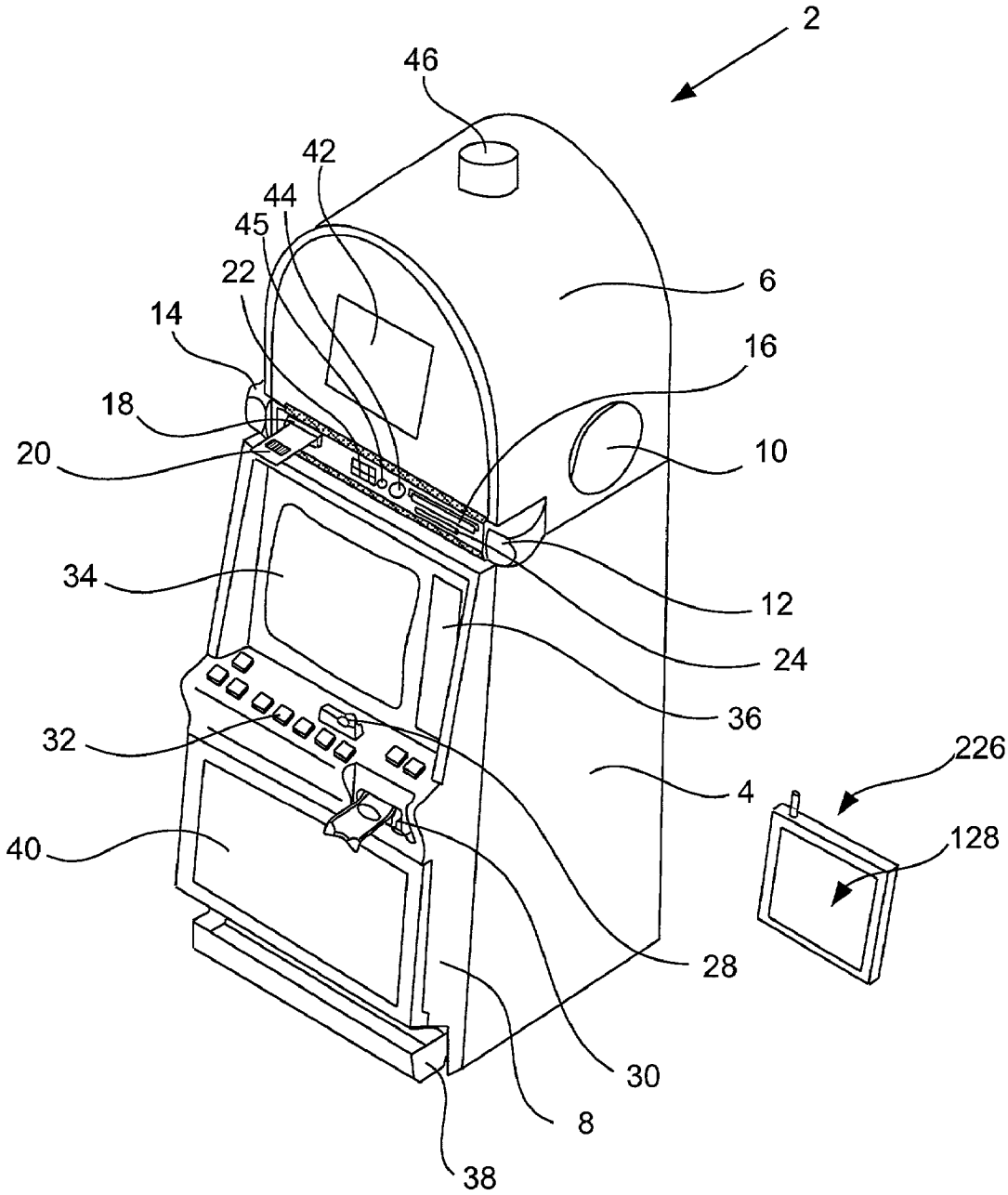
FIG. 4 is a perspective drawing of a gaming machine of the present invention.
Figure 5:
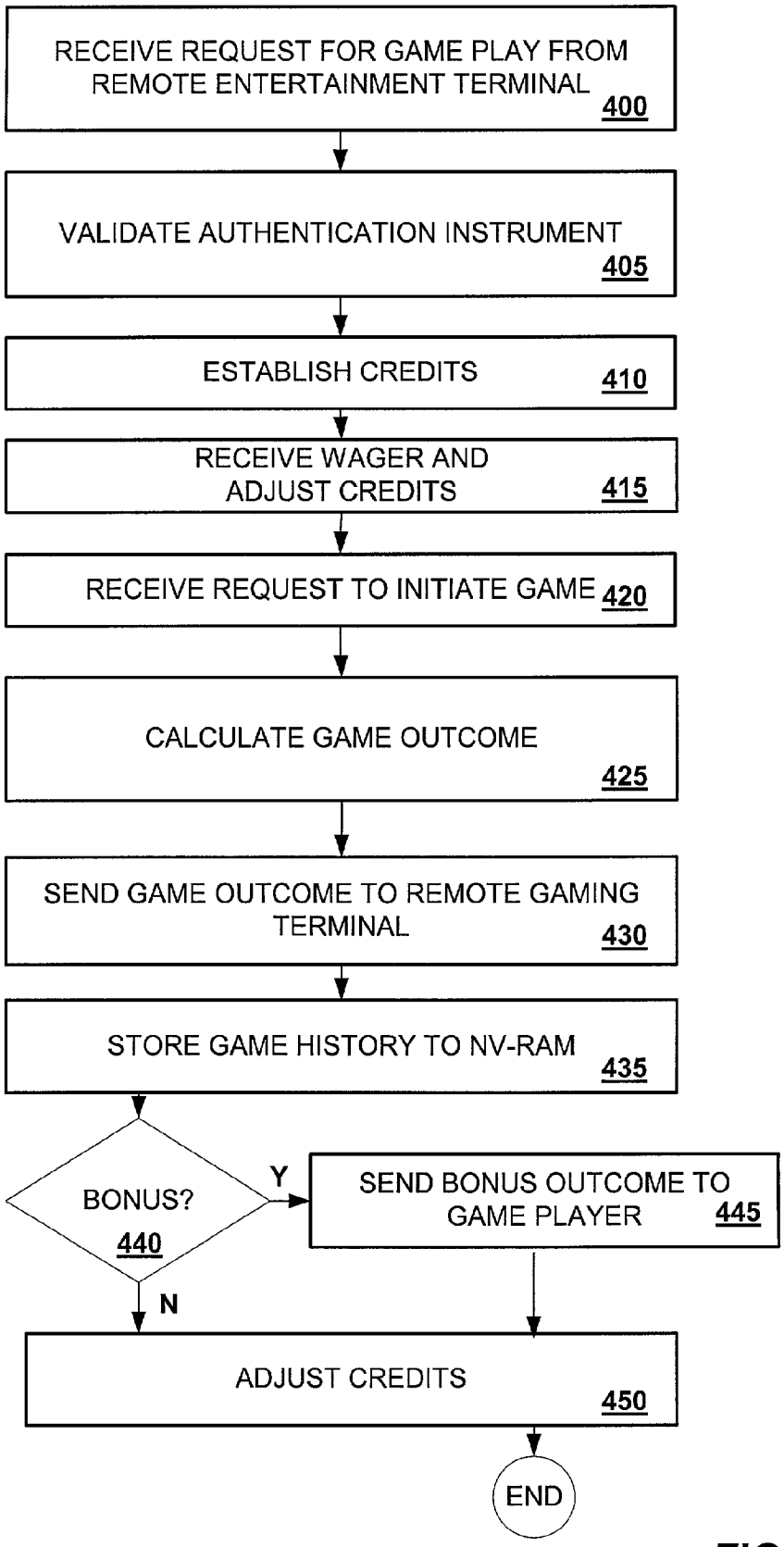
FIG. 5 is a flow chart depicting a method in a gaming machine of providing a game of chance on a remote entertainment terminal activated with an authentication instrument of the present invention.
Figure 6:
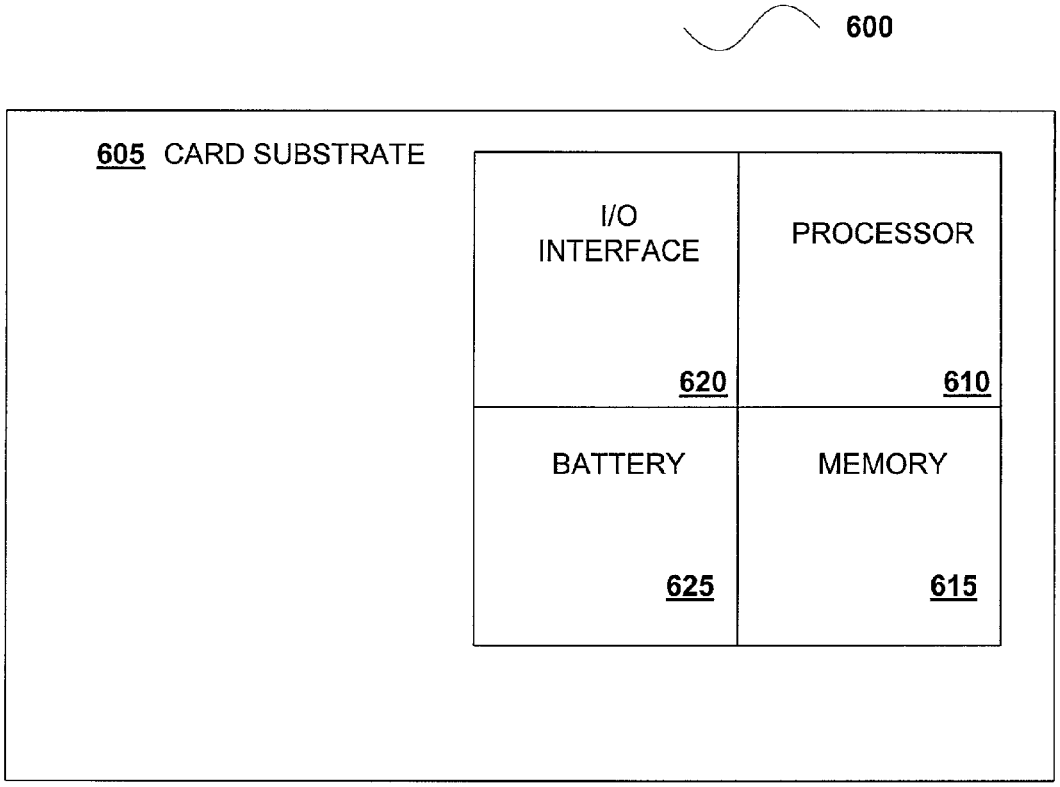
FIG. 6 is a block diagram of an authentication instrument of the present invention.

In FIGS. 1A, 1B, 1C methods of issuing an authentication instrument, using an authentication instrument and approving an authentication instrument transaction are described respectively. In FIGS. 2, 3 and 4, devices and a network architecture for using the authorization instruments in the authentication system of the present invention are described. In FIG. 5, a method in a gaming machine of providing a game of chance on an entertainment terminal activated with an authentication instrument of the present invention is described. In FIG. 6, one embodiment of hardware that may be used as an authentication instrument is described.

FIG. 1A is a flow chart depicting a method of providing an authentication instrument for in-room gaming access. In one embodiment, the authentication instrument and privileges associated with the authentication instrument may be configured when a hotel guest registers at a gaming entity, such as a casino-hotel complex, for an overnight stay. In other embodiments, the authentication instrument may be configured and issued at a kiosk or separate registration desk. In 500, an identity of a user of the authentication instrument is validated. The user may provide a valid picture identification such as passport or driver's license that may be used for identification purposes. In one embodiment, for identification purposes, the user may provide biometric information such as finger print, a signature or a digital photo. For example, to identify the user, the photo, the signature or fingerprint may be compared to a photo or finger print stored in an authentication database. In addition, the identification information received from a user may also be used to establish an audit trail.

The identification information provided by the user may also be input into an authentication system and may be associated with a particular authentication instrument issued to the user. For instance, when initiating a service such as in-room gaming using the authentication instrument, the user may be asked to provide biometric information such as a fingerprint. The finger print information obtained from the user may be compared with previously obtained finger print information. In some embodiments, biometric information may be stored to the authentication instrument. For instance, a smart card may be used to store a user's biometric information.

In 505, room access privileges are determined and the authentication system is configured. Most casino-hotels use card key access systems to grant access to rooms. In one embodiment of the present invention, a card key access system may be used as part of the authentication system where a magnetic striped card or smart card is employed as an authentication instrument.

A user may be granted access to their room, a group of rooms (for instance, a family may share a group of rooms) and various rooms in the hotel-casino complex. For instance, a hotel may contain a spa and spa privileges may be enabled by configuring the authentication instrument and authentication system to grant access to a locked door leading to a spa. As another example, a casino may include special rooms where access is limited, such as high roller room or lounges. Access privileges to the special rooms may be enabled by configuring the authentication instrument to grant access to one or doors with card key access devices leading to the special rooms including elevator access.

Room access privileges may be granted for free or a fee. For example, a user may be granted access to a spa at hotel for fee or if the price of the room is high enough, it may be included in the price of the room. As another example, room access privileges may be based upon a customer history. For instance, a frequent player at a casino or a high roller may be granted certain access privileges that other patrons not falling into these categories may not be granted. The authentication system of the present invention may communicate wit a number of electronic databases that contain customer history information such as a player tracking database.

In most card key access systems that may be used with the present invention, card key access devices with locks that are actuated in response to a magnetic combination are installed on a number of doors. To read the magnetic combination, the card key access devices may include a card reader that can read a magnetically stored combination from a magnetically striped card. In the present invention, the card reader slot serves as an authentication port. As an example, card key access devices may be installed on each door of a hotel in a casino-hotel complex. For large hotels, the number of card keys access devices on doors may number in the thousands.

A card key server stores a list of magnetic combinations for each card key access device. The card key server and an encoding device may be used to encode information, such as one or more magnetic combinations, on an authentication instrument, such as a magnetic striped card or a smart card, to allow one or more card key access devices to be actuated (e.g., a door to be opened). The card key server may also store additional information on the authentication instrument such as a time and date range when the authentication instrument is valid. In some embodiments, the time and the date range may correspond to the time and date of a user's stay at the hotel-casino complex.

The card key server may also store additional information regarding the authentication instrument and its issuance. The information stored on the card key server may or may not be stored on the authentication instrument. For instance, an authentication instrument number, a time issued, a date issued, a location issued, identification information for a person issuing the authentication instrument, a terminal where the authentication instrument was issued, a location where the instrument was issued, identification information for a person who received the instrument, one or more room numbers, an expiration date for the instrument, an expiration time for the instrument, number of instrument issued may be stored on the card key server. A portion of this information may be stored on the authentication instrument such as the expiration date of the card.

In most card key access devices for doors, a card reader attached to the door reads at least a magnetic combination from the card and determines whether a lock on the door is to be actuated. Typically, the card key access device includes a battery for power, a memory storage device that stores a usage record and a programmable logic device that includes operating instructions for the device. When a card is inserted into the door, the card key access device reads information from the card and based upon the information read from the card determines if the locking mechanism is to be actuated. The card key access device may store a record to memory each time a key card is inserted into the card reader.

An important feature of most card key access systems in most hotels is that the card key access devices are not directly connected to a central system and each card key access device typically functions autonomously. For instance, in the card key access devices described above, the logic for determining whether the locking mechanism is to be actuated resides solely in the access device and the card key server is not aware of the access history for each card key access device. In most card key access systems, the memory of an individual card key access device may be interrogated manually by inserting a special card connected to a hand-held device into the card key access device. When the special card is inserted, the access record for the card key access device may be downloaded into the hand-held device and examined. This interrogation feature may be used when theft or some other security violation is suspected.

Autonomous operation of each access device may be advantageous in that it reduces capital costs and maintenance costs associated with each card key access device. For instance, a network for operating the locking devices does not have to be installed and maintained which may lower capital costs and maintenance costs associated with the card key access system. A disadvantage of this approach is that card key access devices have no way of notifying a central system when a potential security violation or a malfunction has been detected.

Most gaming machines have error detection systems and security systems that are designed to detect malfunctions, tampering and other security violations. When a potential malfunction or a security violation has been detected, the gaming machine may shut down and an operator may be notified. To notify an operator, a number of methods may be employed such as activating a light clearly visible on the gaming machine and/or the gaming machine may send a message to a central server. In the present invention in most embodiments, the in-room gaming may be provided using entertainment terminals connected to gaming machines via a local network in each room (see FIGS. 2 and 3). Using the local network, in-room gaming devices with authentication ports may communicate with a central server (referred to as an authentication server—see FIG. 3). In one embodiment, the authentication server may also function as a card key access server.

Thus, using the authentication system of the present invention, the in-room gaming devices that accept authentication instruments via one or more authentication ports may operate: 1) in an autonomous manner, 2) under the control of the authentication server or 3) combinations thereof. This differs from traditional card access systems installed in hotels where the remote devices that accept card keys operate in an autonomous manner and are unable to communicate with a central server. Further, the in-room gaming devices may be designed to be remotely configured by the authentication server and to receive configuration information from the authentication server, such as authentication information. For example, an authentication server may send a command to an entertainment terminal that configures it to allow in-room game play or block in-room game play. In addition, the in-room gaming devices may be designed to send operational information, such as access records, to the authentication server. Further, in some embodiments, the card key access devices installed on each room of the present invention may be designed to communicate with the authentication server.

Returning to FIG. 1A, in 510, in-room gaming privileges are determined for the guest and the authentication system is configured in accordance with the selected privileges. The determination of in-room gaming privileges may be based upon the ages of guests in a given room. For instance, guests with children may not be allowed to participate in in-room gaming. In-room gaming privileges may only be extended to guests with an established relationship with the casino. The relationship with the player for granting in-room gaming may be determined through examination of information from one or more loyalty programs associated with the hotel-casino complex such as a casino slot club. As another example, in-room gaming may only be available in certain rooms in a certain price range. A guest desiring to participate in in-room gaming may be offered a room up-grade to a room allowing in-room gaming services.

Once the in-room gaming privileges are determined, the authentication system is configured to respond to the granted privileges. For instance, when in-room gaming privileges have not been granted and the user is staying a room that has an entertainment terminal, the authentication system may be configured to block in-room gaming. The in-room gaming privileges may be blocked in a number of ways. For instance, a code may be written to the authentication instrument such that when it is inserted into an authentication port in an entertainment terminal the in-room gaming privileges are blocked. In another embodiment, the authentication server may send a message to the entertainment terminal that configures the entertainment terminal to block in-room gaming services on the entertainment terminal. In yet another embodiment, the authentication server (see FIGS. 1C and 3) may be used to approve or reject in-room gaming transactions and the authentication server may be configured to reject any in-room gaming transaction originating from entertainment terminals located in rooms where in-room gaming privileges have not been approved.

When in-room gaming privileges have been established, different components of the authentication system, such as but not limited to the authentication instrument, devices with authentication ports, devices in communication with the devices with authentication ports, the authentication server and other servers in communication with authentication server, may be configured to allow the determined gaming privileges. Many different authentication system configurations may be employed that allow in-room gaming at the determined privilege level. A few examples of the authentication system configurations are described as follows for illustrative purposes only and the authentication system is not limited to these configurations.

The parameters encoded on the authentication instrument may be used be various devices in the authentication system to provide different services. For example, the authentication instrument may be used like a key to allow in-room gaming such that the in-room gaming functions are blocked unless the authentication instrument is inserted into an authentication port connected to the entertainment terminal. Further, the authentication instrument may be encoded with a number of parameters that enable in-room game play as well as regulate in-room game play. The authentication instrument may also be encoded with additional information that may be used to provide other privileges such as a player tracking session during an in-room gaming session. Some details of parameters that may be encoded on the authentication instrument of the present invention and how the parameters may be used by devices in the authentication system are described in the following paragraphs.

The parameters that may be encoded on the authentication instrument include but are not limited to: 1) an authorization number that authorizes in-room gaming, 2) a unique transaction number that is used for all authorized game play, 3) betting limits, such as per game, per session and per day, 4) a player PIN number which may be entered at the entertainment terminal, 5) player identification information, such as name and identification number, 6) player tracking information that allows the card to be used as a player tracking card, 7) an expiration date, such as a hotel check-out date, after which the card is no longer valid, 8) a magnetic combination that may allow the authentication instrument to be used only with one or more entertainment terminals, 9) credits and other cashless instrument information, 10) promotional credits that may be used for game play but not cashed out, 11) player preferences, 12) one or more encryption keys that may be used for various gaming transactions, 13) a unique card identification number, 14) one or more gaming machine serial numbers corresponding to a remote gaming machine that can provide game play to the entertainment terminal, 15) biometric information that may be used for identification purposes, 16) player account information, 17) an authorization number for in-room wagering such as sports bet and 18) a magnetic combination that allows the authentication instrument to be used with one or more door access devices. The information encoded on the card to allow in-room gaming may be in addition to any other information already stored on the card such as room access information.

The information encoded on the authentication instrument may be used by other devices in the authentication system or in communication with the authentication system. For example, the authorization number may be used by the authentication server, a gaming machine and the entertainment terminal to authorize gaming transactions. The unique transaction number may be stored as part of a record of all game play that is authorized with the authentication instrument. The records may be stored on the entertainment terminal, the authentication server and in some cases the authentication instrument (e.g., a smart card). The betting limits may be used by the entertainment terminal, the authentication terminal or combinations thereof to regulate the in-room game play. The player PIN number may be entered by the player to start in-room gaming sessions on the entertainment terminal and to initiate player tracking sessions. The player identification information may be used for auditing purposes by the authentication server. The player tracking information may be used by a player tracking server to track a player's game play on the in-room entertainment server. The player tracking information may also allow the authentication instrument to be used as a player tracking card in a regular gaming machine. Thus, the authentication system and a player tracking system may communicate to correctly configure the authentication instrument.

The expiration date may be used by the entertainment terminal, the authentication server and the gaming machine to accept or reject requests for game play. The expiration date may be stored as part of a gaming transaction by one or more of devices in the authentication system. The expiration date may correspond to a time where the user has access to the room with the entertainment terminal. The magnetic combination may be used by one or more entertainment terminal or an authentication server to authorize in-room gaming.

The authentication instrument may include a magnetic combination that allows the authentication instrument to only be used with one or more specified entertainment terminals. The entertainment terminal combination may be based on a combination stored on the entertainment terminal similar to door access devices or the combination on the terminal may be configured remotely by the authentication system when in-room gaming is authorized. For instance, the authentication server may send a command or instructions in a message for the entertainment terminal to configure itself with the magnetic combination specified in the message. The credits and cashless transaction information may be encoded on the authentication instrument to allow the authentication instrument to be used for gaming in a cashless system. The cashless transaction information may include a number of parameters such as a time, date, transaction number, location, machine identification number that allows a cashless server to process the cashless transaction. The credits may be applied to in-room game play as well as to game play in a casino. Details of cashless systems, cashless transactions and cashless transaction information that may be initiated with the authentication instrument of the present invention are described in co-pending U.S. application Ser. No. 09/648,382, by Rowe, filed Aug. 25, 2000 and entitled "A Cashless Transaction Clearinghouse," which is incorporated herein by reference in its entirety and for all purposes.

The promotional credits stored to the authentication instrument may be used for in-room gaming as well as casino game play. Typically, the promotional credits may not be redeemed for cash but used only for game play. In another embodiment, the player preference information may be used to configure the entertainment terminal to suit the preferences of the player in regards to in-room game play. Details of player preferences that may be stored on the authentication instrument are described in co-pending U.S. application Ser. No. 09/819,152, by Paulsen et al., filed on Mar. 27, 2001, entitled, "Interactive Game Playing Preferences," which is incorporated herein by reference in its entirety and for all purposes.

The one or more encryption keys may be used for secure communications and authentication purposes between devices such as the entertainment terminal, gaming machines and the authentication server. For instance, when a public key infrastructure is used, the authentication instrument may be encoded with a private encryption key and one or more public encryption keys that may be used for gaming communications. The private encryption key may be used by the entertainment terminal and in some cases the authentication instrument to authenticate and decrypt communications. When a private encryption key is encoded on the authentication instrument or when the entertainment terminal is configured with a private encryption key, a corresponding public encryption key may be distributed to devices that may communicate with the entertainment terminal such as a gaming machine or the authentication server. Details of some public key infrastructure methods that use public and private encryption key pairs are described in co-pending U.S. application Ser. No. 09/993,163, filed Nov. 16, 2001, by Rowe et al, and entitled "A Cashless Transaction Clearinghouse," which is incorporated herein by reference in its entirety and for all purposes.

The unique card identification number may be used to verify the authenticity of the card. The card identification number may be used by devices in the authentication system such as an authentication server as well as other devices in communication with the authentication system such as a cashless system server and a player tracking server. The one or more unique gaming machine serial numbers or identification numbers may be used identify the gaming machines that may be used to provide the in-room gaming and for auditing purposes. For instance, the gaming machine serial numbers or identification information may be used by the entertainment terminal to contact a gaming machine that may be used to provide in-room gaming. The gaming machine may have been configured with information regarding authorized transactions from the entertainment terminal and may only respond when it receives the correct information.

The biometric information may be used to initiate a gaming session. For instance, a smart card used the authentication instrument may store information regarding a player's finger print which may be verified using a finger print terminal on the entertainment terminal (see FIG. 2). As another example, to collect their winnings a signature stored on the authentication instrument may be compared with a signature of the player written on the authentication instrument or written on a transaction receipt by the player. The account information stored on the card may be used to allow the entertainment terminal to access one or more player accounts used by the player. For instance, the account information may allow the player to perform an electronics fund transfer at the entertainment terminal.

Returning to FIG. 1A, the authentication instrument and devices in the authentication system may be configured to grant additional privileges. For instance, the authentication instrument may be configured to allow the user to view premium movie channels, play video games and obtain internet access using the entertainment terminal. As another example, the authentication instrument may be configured so that it may be used to gain access to an in-room safe and mini-bar. As another example, the authentication instrument may be configured to grant access to special gaming machines or special features on gaming machines on the casino floor. For example, a gaming machine on the casino floor may require the user to insert the authentication instrument into the machine before it can be played. As another example, special bonus modes on different gaming machines may only be authorized when the authentication instrument has been configured to authorize the bonus modes and the authentication instrument has been inserted in the gaming machine. In yet another example, the authentication instrument may be configured as a hotel charge card where the user may charge food services to their room bill.

In 525, the authentication instrument information encoded on the authentication instrument may be stored on the authentication server and other gaming devices. The authentication instrument information may specify the particular configuration of the authentication instrument such as what privileges may be granted through using the authentication instrument. For example, two examples of what information may be configured on the authentication instrument are i)

access privileges for one or more rooms and ii) in-room gaming privileges on an entertainment terminal in the one or more rooms. As another example, the instrument may be configured with cashless transaction information that allows the authentication instrument to be used as a cashless instrument. The cashless transaction information may also be stored on the authentication server and a cashless system server. The information stored on the authentication server may be used to allow various transactions as described above, for security purposes and to quickly replace the card when it is lost. In 530, the authentication instrument may be issued to the player. After the card is issued, a patron may use the authentication instrument to obtain the various privileges for which the instrument has been configured.

In some embodiments of the present information, an authentication instrument may be provided to a user by the gaming entity where the instrument is to be used. For example, a smart card, a magnetic striped card, an electronic token, a wireless device, such as a device worn using a wrist band or an arm band, may be issued to the user by the gaming entity for use an authentication instrument. In other embodiments, the user may provide a magnetic striped card of some type already in their possession for use as an authentication instrument. For example, for use as an authentication instrument, the user may provide a credit card, a debit card, a library card, a frequent flier card, a grocery card, a player tracking card, a driver's license or some other acceptable instrument that they normally carry. In this embodiment, information may be read from the instrument provided by the user and stored by the authentication system. In addition, information, such as a magnetic combinations for door access devices and entertainment terminals, may be stored on the user provided card to enable its use with devices in the authentication system as described above. One advantage of using an instrument provided by the user is that the costs associated with providing authentication instruments by the casino may be reduced. Another advantage of this approach is that the user does not have to remember to bring an additional authentication instrument that they are not used to carrying to use the authentication system of the present invention.

Although most hotels currently use door access devices that use a card reader as an interface for reading magnetic striped cards or smart cards, the present invention is not so limited. For instance, future door access devices may use wireless interface systems that are compatible with a cell phone, a personal digital assistant or other portable electronic devices that may be carried by a person desiring to entry to a room using the door access device. The devices in the authentication system of the present invention may be adapted to use wireless interfaces for communication with portable electronic devices that may be carried by a patron. For example, access codes to doors and authorizations for gaming services may be programmed into a player's cell phone or personal digital assistant such that the information stored on the cell phone or personal digital assistant may be used as an authentication instrument in the authentication system. A wireless interface installed on devices used in the authentication system of the present invention may be used to read information from the portable electronic devices.

FIG. 1B is a flow chart depicting a method of providing in-room gaming using an authentication instrument of the present invention. In 700, in response to the insertion of an authentication instrument into a first authentication port, access is granted to a hotel room. As an example, a magnetic striped card used as the authentication instrument may be inserted into a card slot serving as an authentication port for a card reader used in a door access device. Typically, the door access device reads information from the authentication instrument and actuates a lock to the hotel room when it is able to read the correct magnetic combination from the authentication instrument. A record of the interaction between the door access device may be stored by the door access device and in some cases may be stored by the authentication instrument.

In 705, in response to the insertion of the authentication instrument into a second authentication port, access may be granted to an entertainment terminal. As an example, the second authentication port may be a card slot connected to a card reader in an entertainment terminal located in the hotel room. The entertainment terminal may read authentication instrument information from the authentication instrument. When a wireless interface is used to read the authentication information from the authentication instrument, it may not be necessary to insert the authentication instrument into an authentication port. For example, the authentication instrument may be aligned with a wireless interface or placed in proximity to a wireless interface to allow information to be read from the authentication instrument. Using the information read from the authentication instrument, the entertainment terminal may determine whether in-room game play is allowed and initiate a game play session using parameters specified by the authentication instrument as described with respect to FIG. 1A. The player may be prompted to supply identification information such as PIN number or biometric information such as a finger print before game play can begin on the entertainment terminal.

In one embodiment, the entertainment terminal may contact an authentication server to validate the authentication instrument and the parameters specified by the authentication instrument. Further, the authentication server may send an authorization message to the entertainment terminal which allows the entertainment terminal to begin and in-room gaming session. The authentication server as well as the entertainment terminal may store information regarding the game play session such as a time started, time ended, number of games played, amount wagered, amount won, etc. The information during the in-room gaming session may be used for auditing, marketing and security.

In 707, when a in-room game play session has been authorized, the entertainment terminal may contact a remote gaming machine and establish communications with the remote gaming machine. Since the gaming machine and the entertainment terminal are typically located in separate locations, the gaming machine may be considered remote to the entertainment terminal and the entertainment terminal may be considered remote to the gaming machine. In one embodiment of the present invention, the remote gaming machine may control the entertainment terminal as a remote display and remote input device where the remote gaming machine serves as master device and the entertainment terminal is a slave device. As described with respect to FIG. 1A, the authentication instrument may store information that may be used in establishing a relationship between the gaming machine and the entertainment terminal. For instance, the authentication instrument may specify identification information regarding what gaming machine the entertainment terminal may contact such as gaming machine serial numbers. Further, the authentication instrument may store private encryption keys used to establish secure communications with the gaming machine. In addition, the authentication instrument may a unique transaction number that is to be used for all game play sessions enabled with the authentication instrument which may be validated by the gaming machine.

In 710, credits are established on the gaming machine in communication with the remote entertainment server. In one embodiment, the authentication instrument may be used as a cashless instrument in a cashless system. When the authentication instrument is used as a cashless instrument, the authentication instrument may store credits that may be used for game play and information allowing the remote gaming machine and a cashless server in a cashless system to validate the credits for game play. In another embodiment, the authentication instrument may store account information such as a credit line established with the casino-hotel, credit card information or banking information that may be used to establish credits on the remote gaming machine. In yet another embodiment, as described with respect to FIG. 1C, the authentication instrument may store information regarding promotional credits that may be established on the remote gaming machine for game play.

In 715, after credits have been established on the gaming machine, a user may make a wager and may initiate a game of chance on the entertainment terminal using the input devices connected to the entertainment terminal as remote extension to the gaming machine. As noted above, since the gaming machine and entertainment terminal are located in separate locations and in communication via a network, from the perspective of the entertainment terminal the gaming machine is a remote device but from the perspective of the gaming machine the entertainment terminal is a remote device. The input signals from the entertainment terminal may be communicated to the gaming machine using the network used by the casino-hotel complex. In 720, an outcome for the game of chance is generated on the remote gaming machine.

In 725, the game outcome for the game of chance, including credits won or credits lost, may be displayed to the entertainment terminal by the gaming machine. When credits are available, the user may continue to play games on the remote entertainment terminal. However, as described with respect to FIG. 1A, the authentication instrument may be used to regulate various aspects of the game play session. For example, the game play session may be limited by the original amount of credits stored on the authentication instrument. As another example, the length of each game play session may be limited according to parameters stored on the authentication instrument. In yet another example, the amount wagered for a given game play session or over a particular time period may be limited by parameters stored on the authentication instrument.

An important aspect of game play on a gaming machine is dispute resolution. In the present invention, all results of the game play history used for dispute resolution may be stored on the gaming machine as is done for casino play. Typically, in the case of malfunctions, such as a power failure or hardware malfunctions, the gaming machine has built-in features that allow it to preserve and reconstruct information. In the present invention, the gaming machines may be designed to detect errors involving remote game play on an entertainment terminal and preserve a recoverable game play history. For example, the gaming machine may be designed to preserve a record of a remote game play session so that if a disconnect occurs between the gaming machine and the entertainment terminal, the current state of the game play session may be reconstructed. In this case, the record of the remote game play session may include information regarding what remote entertainment terminal the gaming machine was connected to during an in-room game play session and details of the game play session, such as when it was initiated and who initiated the session, as well as a game history such as the state of the gaming machine. In other embodiments, the entertainment terminal, the authentication instrument or combinations thereof may also be designed to store game play history information.

In another embodiment, the gaming machine may be designed to transmit game play history information to a remote attendant station for dispute resolution involving in-room game play. For instance, the remote attendant station may be able to view game play results displayed on an entertainment terminal and retrieve game play history information and game play session information from a remote gaming machine. In some cases, an attendant at the remote attendant station may be able communicate with a game player using the entertainment terminal via a speaker and microphone installed on the entertainment terminal. Also, a person may be dispatched from the remote attendant station to the hotel room for dispute resolution purposes or to fix malfunctioning hardware.

One advantage of using a gaming machine and an entertainment terminal as a remote extension of the gaming machine to provide in-room gaming services is that the regulatory aspects and hardware modifications may be minimized. Since gaming machine are generally designed to send output to a display and receive inputs from various devices, the modifications to the gaming machine to send output to a remote display and receive inputs from remote input devices may be relatively simple. Thus, standard gaming machines used for casino play or components of standard gaming machines may be used to generate the in-room game play. The standard gaming machines used for casino play will have gone through the regulatory process. Thus, the process may not have to be repeated with the gaming machine to provide in-room game play. Further, with the use of standard gaming machines, all of the features developed for casino game play on the gaming machines may be easily transferred to in-room gaming such as player tracking functions.

FIG. 1C is a flow chart depicting a method of providing authentication instrument transaction using an authentication instrument server. As described above with respect to FIGS. 1A and 1B, in-room game play sessions may be authorized by an authentication server. Information used to authorize the in-room game play session may be stored on an authentication instrument.

In 800, the authentication server receives an authentication transaction request from a device that accepts an authentication instrument. The authentication transaction request may be used to validate authentication instruments used in the authentication system and to request approval for any service generated by devices in the authentication system. The authentication transaction request may be a message that is sent from the device to the authentication server. The authentication transaction request message may include information such as information read from an authentication instrument that is needed by the authentication server to complete the transaction. As an example, a patron may insert an authentication instrument into an entertainment terminal and request an in-room game play session. In response, the entertainment terminal may send a message to the authentication server requesting an authentication of the information read from the authentication instrument. In addition, the entertainment terminal may request an approval of the in-room game play session.

In 802, the authentication server may determine if the device requesting a transaction is valid. The authentication server may store a list of approved devices. In one embodiment, the authentication process may include the use of public and private encryption key pairs. Details of using public-private encryption key pairs for device authentication are described previously incorporated co-pending U.S. application Ser. No. 09/648,382, by Rowe, filed Aug. 25, 2000 and entitled "A Cashless Transaction Clearinghouse."

In 806, when the device that sent the authentication transaction request is a recognized device, the authentication server may validate the authentication instrument. The authentication instrument may be validated by comparing information read from the authentication instrument with information stored on the authentication server. As described previously with respect to FIG. 1A, when the authentication instrument is issued, information stored on the authentication instrument may be stored on the authentication server.

Further, to validate the authentication instrument or the device, such as an entertainment terminal, that is communicating with the authentication server a two-factor authentication encryption scheme may be used (A smart card is an example of an authentication instrument may be able to communicate with the authentication server). In a two-factor authentication scheme, at the device, information sent to the authentication server may be encrypted with a private key stored on the device and encrypted again with a public key of the authentication server. At the authentication server, the information may be decrypted with a public key of the device corresponding to the private key on the device used to encrypt the information and then decrypted again with a private key on the authentication server corresponding to the public key used by the device to encrypt the information. Since only the device should be in possession of the private key corresponding to the public key used to decrypt the message, the device may be validated. In one embodiment, when the authentication instrument is issued, a private key may be stored on the authentication instrument and used for encryption of information from the authentication instrument. In another embodiment, when the authentication instrument is issued, a public key may be stored on the authentication instrument which is used for encryption and a private key corresponding to the public key may be stored on the authentication server.

In 808, when the device that sent the authentication request and the authentication instrument have been validated, the authentication server may approve or reject an authentication transaction. For example, when an in-room game play session has been requested by an entertainment terminal, the authentication server may check its records to determine whether in-room game play session has been approved for the room where the entertainment terminal is located. The authentication server may also track the amount of game play that has occurred in the room over a certain period of time to see whether game play limits have been exceeded. As another example, in determining whether to approve an in-room game play session the authentication server may check whether a PIN number has been entered correctly or whether sufficient funds are available.

In general, the authentication server may approve or reject transaction requests for any service provided by a device in the authentication system that can communicate with the authentication server. Internet service requests and entertainment requests (e.g., movies or video games) on a entertainment terminal are two other examples of transactions that may be validated by the authentication server. When the transaction request is only to authenticate an authentication instrument, 808 may be skipped.

When the device requesting the transaction in 802, the authentication instrument in 806 or the requested transaction in 808 are not approved, in 804, the authentication server may terminate the transaction and store a record of the transaction. The authentication server may also send a message to the device that requested the transaction indicating the request has been denied. In 810, when the authentication transaction has been approved, the authentication server may generate a message indicating the transaction has been approved and send the message to the device. The message may include information that allows the requesting device to carry out the requested transaction. For example, in one embodiment, when an entertainment terminal has requested an in-room game play session and the transaction has been approved, the authentication server may send a unique game play session number. The game play session number may be required by a gaming machine that will be used generate the in-room game play session. In 812, the authentication server may generate a transaction record and store the record in a database on the authentication server.

FIG. 2 is a block diagram of a hotel room 100 with a number of devices that are used in an authentication system of the present invention. The combination of devices is presented for illustrated purposes only and the present invention is not limited to the combination of devices shown in FIG. 2. The room 100 includes: 1) a minibar 121 with a door access device 145 with authentication port 125, 2) a safe 120 with a door access device 145 and an authentication port 125, 3) a door 118 with a door access device 145 with authentication port 125, 4) an entertainment terminal 225 comprising a display 113, which may be a television, and a set-top box 101 and 5) a hand-held entertainment terminal 226.

The set top box 101 includes a card slot for a card reader 110, a serial port 109 and an electronic token acceptor 111. The hand-held entertainment terminal 226 includes a card reader 141 and an electronic token acceptor 111. The card slot in the card reader 110, the serial port 109, the card slot in card reader 141 and the electronic token acceptor 111 may be used as authentication ports in the present invention. To initiate an in-room game play session, an authentication instrument, such as a smart card or magnetic striped card, may be inserted into card reader 110 or card reader 141. As another example, to initiate an in-room game play session, an authentication instrument, such as an electronic token, may be inserted into the token acceptor 111 in the entertainment terminal 225 or entertainment terminal 226. The authentication ports 125 in the door access device 145, the minibar 121, the safe 120 may be card slots in a card reader or a token acceptor for an electronic token.

The iKey 2000 products by Rainbow Technologies (Irvine, Calif.) are examples of smart cards or electronic tokens that may be used with the present invention. The iKey 2000 smart cards and electronic tokens include a processor and memory and support public-private key encryption methods and two-factor authentication methods involving encryption keys. The iKey 2000 electronic tokens are designed to be inserted into a USB port. Thus, a USB port may be used as an authentication port in the present invention. An example of a smart card is described in more detail with respect to FIG. 6.

In general, the devices with authentication ports in the room 100 may use a common interface. For instance, all of the authentication ports may accept smart cards or magnetic striped cards as authentication instruments. As another example, all of the authentication ports may accept electronic tokens. In yet another example, all of the devices may use a common wireless interface to read information from the authentication instruments and an authentication port may not be required. Thus, preferably, a user may be able to use a single authentication instrument with all of the devices in the room 100 that use information stored on an authentication instrument. For instance, a player may be able to unlock the door 118, unlock the safe 120, unlock the minibar 121, initiate an in-room game play session or use in-room entertainment services using a single authentication instrument.

The devices with authentication ports may operate autonomously or non-autonomously of the authentication server and of other devices in the authentication system. When a device is operating autonomously, it does not require additional information or instructions from the authentication server or other devices connected to the authentication system to perform a particular function. For example, the door access devices 145 on the minibar 120, the safe 120 and the door 118 may operate autonomously of the authentication sever. Thus, all of the information required to actuate the lock with the door access device 145 may be contained in the access device 145 and the authentication instrument.

In one embodiment of the present invention, although the door access devices operate autonomously of the authentication server and other devices connected to the authentication system, the access devices 145 may include wireless interfaces, such as devices using Bluetooth™ wireless standard, that allow the access devices 145 to transmit and receive information via wireless communications 122. For instance, the door access device 145 may send or receive a wireless communication 122 using a wireless interface to the wireless interface 108 in the set top box 101 which is connected to the local network 122. Thus, when the door access device grants access to the room 118, access information may be transmitted to the authentication server.

When a device is operating non-autonomously, it may require additional information or instructions from the authentication server or another device connected to the authentication system to perform a particular function. For instance, as described with respect to FIG. 1C, the entertainment terminals 225 and 226 may require approval from the authentication server to initiate an in-room game play session. As another example, to display a game of chance 116 on the display 113 or the display 128, the entertainment terminals may require input from a remote gaming machine. Some devices in the present invention may operate both autonomously and non-autonomously. For example, the entertainment terminals may provide entertainment services such as video games in an autonomous manner but provide in-room gaming in a non-autonomous manner.

The entertainment terminals 225 and 226 may provide in-room game play sessions and other entertainment services such as movies and Internet access. The entertainment terminal 225 includes a set top box 101 and a display 116. The set-top box 101 is connected to a local network 122 and the display 113. Through the local network 122, the set-top box may communication with the authentication server, gaming machines and other devices connected to an authentication system. In one embodiment, the set top box includes a key pad 103, a touch screen display, a camera 104, a speaker 105, a microphone 113, a finger print reader 115, a serial port, 109, a card reader 110 and a finger print reader 115, and a controller 107 with input buttons 106.

A few functions of the devices on the set-top box 101 are described but the present invention is not limited to these functions. The key pad 103 may be used to enter a PIN number and as service buttons. The touch screen display 102 may be used to provide an alpha-number interface and to display a bonus game. The camera 104 may be used to enter biometric information. In one embodiment, the camera 104 may be activated during in-room game play sessions for security and to insure the player are of a legal age. The speaker 105 and microphone 113 may be used to communicate with a remote attendant in the case of malfunctions or disputes or to request services such as room service. The finger print reader 115 may be used to enter biometric information used to validate the player identity.

The card reader 110, the token acceptor 111 and the serial port 109 which may be a Universal Bus Port may be used to accept authentication instruments. The wireless interface 108 may be used to communicate with a wireless network and devices using wireless communications such as a personal digital assistant or cell phone. The controller 107 with input buttons may be used to play a game of chance 116 on the entertainment terminal 225, to play video games or to obtain Internet services. The game of chance 116 is presented on display 113. The display 113 includes status information such as credits and a game denomination.

Some of the functions of the set top box may be similar to the functions performed by a player tracking unit installed on a gaming machine. Further, similar to a player tracking unit, the set-top box 101 may include internal hardware, such as a non-volatile memory for storing game play session information, a processor and network interface for communicating with a gaming machine. In one embodiment of the present invention, a player tracking unit may be adapted to serve as a set top box for in-room gaming. Details of a player tracking unit with functions that may be provided on a set top box of the present invention and hardware that may be incorporated into a set-top box are described in co-pending U.S. application Ser. No. 09/921,489, filed on Aug. 3, 2001, by Hedrick et al. and entitled "Player Tracking Communication Mechanisms In A Gaming Machine," which is incorporated herein by reference in its entirety and for all purposes.

Details of the hand-held entertainment terminal 226 are now described. The hand-held entertainment terminal consists of a housing 112, touch screen display 128 switch panel 144, battery, wireless communication interface including antenna 124, and controller. The entertainment terminal may include a card reader 141 and a token acceptor 111 that may accept authentication instruments. In one embodiment of the present invention, a modified DT Research WebDT pad (DT Research, Inc., Milpitas, Calif.) is used as a wireless game player. However, the present invention is not limited to the DT research WebDT pad as other hand-held wireless devices such as personal digital assistants (PDA) may also be used. Additional details of a hand-held entertainment terminal that may be used with the present invention including network architectures and interfaces to a gaming machine are described in co-pending U.S. application Ser. No. 09/967,326, filed on Sep. 28, 2001, by Wells and entitled, "A Wireless Game Player," which is incorporated herein by reference in its entirety and for all purposes.

In one embodiment, the entertainment terminal 226 may be approximately 10.5×9.5×1.0 inches in size, weigh 3 pounds and use a 10.4 inch color LCD touch screen display. Typically, an 8 inch to 10.4 inch display provides a sufficient viewing area without reducing the size of the character fonts to a point where they are unreadable by most players. The touch screen (sensor) is overlaid on the displayable surface of the LCD 128. Other display technologies can be used instead of LCD, plus some display technologies will incorporate a built-in touch screen (internal vs. external). To activate the touch screen display 128 a stylus 130 may be used, but most people will use their fingers.

Audio is available via the small built-in speaker 140 or an external headset. Lighting schemes, such as arrays of LEDs, may be added to the entertainment terminal to provide visual effects and to communicate status information to a game player. Status information, such as a battery level and connection status, may be provided by the status lights 132. The layout and number of the input buttons, including 138 and 136, is variable. In one embodiment, the battery will last 5 hrs between charging. Charging of the wireless game player may be accomplished by setting the wireless game player in a special storage cradle. The storage cradle may be located in room 100 and may also provide a network connection to the local network 122.

In a particular embodiment, the entertainment terminal 226 may use an IEEE 802.11b compliant wireless interface. It is a 2.4 Ghz Direct Sequence Spread Spectrum radio system. It has a range of up to 330 ft (inside) from any access point. The data rate is 11 Mbps. IEEE 802.11b is a commonly used radio standard, but the present invention is not limited to this standard. Other wireless standards that may be used include IEEE 802.11a, IEEE 802.11x, hyperlan/2, Bluetooth™, IrDA, and HomeRF. These wireless standards may also be applied to other devices with wireless capabilities such as access devices 145.

As described with respect to FIG. 1B, the entertainment terminals 225 and 226 may be used as remote extensions of a gaming machine. As remote extensions to the gaming machine, the entertainment terminals may used as remote input devices for the gaming machine and remote displays for outcomes generated on the gaming machine. However, all of the regulated aspects of the game play such as the hardware and software used to generate the game of chance reside on the gaming machine. During remote game play, the entertainment terminals, 225 and 226, may communicate with the gaming machine via the local network 122. The local network 122 may provide a wired network architecture, a wireless network architecture or combinations thereof. Details of an example of one network topology that links gaming machines to entertainment terminals is described with respect to FIG. 3.

FIG. 3 is a block diagram of hotel-casino complex with a plurality of devices that use authentication instruments of the present invention. The authentication instruments may be issued at the registration are 223 for the hotel 211 using the methods described with respect to FIG. 1A. The hotel 211 includes an authentication server 214 that may be used to store authentication instrument information, an entertainment server 213 that may be used to provide various entertainment services, an attendant station 212 that may be used for monitoring in-room game play, a plurality of rooms, such as room 100. Among other functions, the authentication instrument issued in registration area 223 may be used to gain access to room 100 and to engage in-room game play session using the entertainment terminal 225.

The registration area 223, the entertainment server 213, the attendant station 212 and the devices in room 100 may be communicate with one another via local network 122. The local network 122 is connected to a casino area network 245. Using the local area network 122 and the casino area network, an entertainment terminal may establish a connection with a remote gaming machine that provides in-room game play. The in-room game play session may be initiated after approval from the authentication server 214.

Gaming machines 265, 266, 267, 268, 269, 275, 276, 277, 278 and 279 are located in a floor area of casino 205. The gaming machines are connected to a player tracking system 210 via a data collection unit 255. As described above with respect to FIG. 1A, the authentication instruments of the present invention may be used to trigger special bonus features on the gaming machines, store promotional credits, store regular credits, store player tracking information and store player preferences that may be used to configure the gaming machine.

An authentication port 125, such as a card slot in a card reader, in gaming machines, 265 and 279, may be used to accept an authentication instrument. For instance, the authentication instruments of the present invention may be used to initiate a player tracking session. Although not shown, each of the gaming machines in FIG. 3 may include one or more devices, such as card readers or wireless interfaces, that read information from an authentication instrument. Gaming machines 275, 276, 277, 278 and 279 are located in a special room 203. For instance, room 203 may be a high roller room with special gaming machines. In one embodiment of the present invention, an authentication instrument may be used with the access device 145 with authentication port 125 to gain access to the room 203 through door 202.

In-room game play, such as in room 100 as described with respect to FIG. 2, may be enabled by gaming machines executing licensed and regulated gaming software. Some of the gaming machines used for generating in-room game play sessions may be located on the casino floor 205. For instance, gaming machines, such as 265, 266, 267, 268, 269, 275, 276, 277, 278 and 279 may be used to generate in-room game play sessions as well as game play on the casino floor. As another example, gaming machines, such as 235, mounted in racks or containers in a restricted area 231 off of the casino floor 205 may be used solely to generate remote game play, such as in-room game play sessions on entertainment terminals. The gaming machines 235 may be connected to a casino area network 245 and communicate with remote devices via the casino area network 245. As another example, a remote game server 230 with multiple processors may be used to support simultaneous game play on a plurality of entertainment terminals.

The game play sessions are denoted as remote game play sessions because a game of chance may be initiated and played on a gaming machine, such as gaming machines 235, by a game player that is not in a physical location proximate to the location of the hardware where the game of chance is generated. The game of chance is generated by a master gaming controller on the gaming machine. Usually, such as on a casino floor, a player has to stand in front of a gaming machine to play the game of chance where the master gaming controller is located in the main cabinet of the gaming machine in front of the player. Thus, to play the game of chance on the gaming machine, the player is required to be in a location, which is proximate to the gaming machine. In the present invention, when authorized, the player may play a game of chance on a gaming machine using a remote gaming extension such as an entertainment terminal. In this example of a remote game play session, the master gaming controller that generates the game of chance is in a physically separate location from the entertainment terminal. Therefore, the player may not be in a physical location proximate to where the game of chance is generated.

The gaming machines 235 dedicated to remote game play may be stripped down and may not include display screens or other devices such as bill validators, coin acceptors, coin hoppers, light displays that are used by gaming machines on the casino floor. However, the gaming machines may be still regulated and licensed in a manner similar to traditional gaming machines and may use the same hardware and software to generate a game of chance as the gaming machines deployed on casino floor 205.

The remote game server 230 and gaming machines 235 that generate remote game play sessions may be networked similarly to the gaming machines on the casino floor and provide similar gaming services. For instance, the remote game server 230 and remote capable machines are connected to the player tracking server 210. Thus, game play on an entertainment server, such as 225, generated by a remote gaming may generate player tracking points. Further, a player using an entertainment server, such as 225, may be able to utilize services traditionally offered through player tracking devices on gaming machines such as a drink request. To provide the player tracking services, a player tracking service interface may be displayed on the touch screen of the in-room entertainment server or may be provided through the set-top box of the entertainment server.

The gaming machines located on the casino floor 205, the remote game server 230 and the remote capable gaming machines 235 may also be connected to other servers such as but not limited to cashless system servers, progressive game servers, bonus game servers, prize servers, Internet servers, an entertainment content server, a concierge service server and a money transfer server (e.g., a server that enables electronic fund transfers) and the like. Game services offered by the remote servers connected to the gaming machines may also be offered on the entertainment terminals, such as 225. The game service privileges available on the entertainment terminal may be specified using the authentication instrument. As an example, a game player may participate in a progressive game using the entertainment terminal 225. In another example, a game player may be able to perform a cashless transaction enabled by a cashless system and cashless system server 215, such as the EZPAY™ cashless system (IGT, Reno Nev.), using the entertainment terminal 225.

In FIG. 4, a video gaming machine 2 of the present invention is shown that may communicate with a portable entertainment terminal 226 with touch screen display (see FIG. 2). In FIG. 2, details of a gaming machine and additional gaming services that may be generated on a gaming machine providing remote game play sessions are described. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The main display monitor 34 will typically be a cathode ray tube, high resolution flat-panel LCD, or other conventional electronically controlled video monitor. The gaming machine 2 includes a top box 6, which sits on top of the main cabinet 4. A second display monitor 42 may be provided in the top box. The second display monitor may also be a cathode ray tube, high resolution flat-panel LCD or other conventional electronically controlled video monitor. In addition, the gaming machine 2 is designed to communicate to the portable entertainment terminal 226 with display 128. As described with respect to FIG. 2, the entertainment terminal may provide a remote extension to gaming machine 2.

Typically, after a player has initiated a game on the gaming machine, one purpose of the main display monitor 34, the second display monitor 42 or the remote display 126 is the visual display of a game outcome presentation, including bonus games, controlled by a master gaming controller 224 (not shown). Also, the main display monitor 34, the second display monitor 42 and the display 128 may also be utilized to display entertainment content independent of the game outcome presentation. For example, broadcast events, including television programming, may be provided to the main display monitor 34, the secondary display monitor 42 or the display 128. The broadcast events may be sent to the gaming machine 2 via a cable link or other suitable link from outside of the gaming machine. All or some subset of the programming provided by a television broadcaster may be displayed as entertainment content on one or more of the video displays. For in-room game play, the visual display may be generated on the entertainment terminal display.

Television programming content of particular interest to casino operators and game players may include, for example, sporting events, talk shows, game shows, soap operas, advertisements, situation comedies, etc. In addition, broadcasts of competitive events on which the player can wager may be displayed. For example, dog racing or horse racing events may be displayed as content on the entertainment terminals. In-room wagering may be authorized with the authentication instrument inserted into the entertainment terminal 226. In such events, there is typically a rather long down time between races. During this period, the player may play games of chance on the entertainment terminal 226 connected to the gaming machine 2. Similarly, the entertainment content may include information available on the Internet, including the World Wide Web, for more technologically sophisticated players.

Returning to the gaming machine in FIG. 4, the information panel 36 may be a back-lit, silk screened glass panel with lettering to indicate general game information including, for example, the number of coins played. The bill validator 30, player-input switches 32, video display monitor 34, and information panel are devices used to play a game on the game machine 2 including the entertainment terminal 226. The devices are controlled by a master gaming controller housed inside the main cabinet 4 of the machine 2. Many possible games, including traditional mechanical slot games, video slot games, video poker, video pachinko, multiple hand poker games, video pai-gow poker, video black jack, video keno, video bingo, video roulette, video craps, video card games and general games of chance, may be provided with gaming machines of this invention. These games may be played using the entertainment terminal 226.

General games of chance refer to games where a player makes a wager on an outcome of the game. The outcome of the game of chance may be affected by one or more decisions may be the player. For instance, in a video card game, the player may hold or discard cards which affects the outcome of the game.

The top box 6 houses a number of devices, which may be used to add features to a game being played on the gaming machine 2, including speakers 10, 12, 14, a ticket printer 18 which may print bar-coded tickets 20, a key pad 22, a florescent display 16, a camera 45, microphone 44 and a card reader 24 for entering a magnetic striped cards or smart cards. The speakers may be used to project sound effects as part of a game outcome presentation. The top box also includes a candle 46. The candle is a light that may be activated by the master gaming controller on the gaming machine. The key pad 22, the florescent display 16 and the card reader 24 may be used for to enter and display player tracking information. As another example, the player may enter playing tracking information and identification information using the card reader 24 and the main video display 34 where the main video display may be used as a touch screen to enter information. Player tracking information may be entered into the gaming machine before a player initiates a game on the gaming machine. Typically, the player's incentive to enter player tracking information into the gaming machine 2 is potential rewards related to the amount of a player's game play. All or a portion of these features may be duplicated using an entertainment terminal. For instance, as described with respect to FIG. 2, the entertainment terminal may include a key pad, card reader and other input devices used to enter player tracking information.

In addition to enabling player tracking services, the key pad 22, the florescent display 16 and the card reader 24 may be used to enter identification information that enables a player to access entertainment content or receive personal messages on the gaming machine independent of a game play and game outcome presentation on the gaming machine 2. For example, a player may enter a personal identification number into the gaming machine 2 using the key pad 22 that allows the player to receive entertainment content such as viewing a movie or a broadcast event. As another example, after entering the personal identification number, the player may be allowed to receive a personal message indicating a table is ready at a restaurant in the casino or to receive a personal message containing information on a sporting event such as a score of personal interest to the player utilizing the gaming machine. These services may be duplicated on the entertainment terminal 226.

In addition to the devices described above, the top box 6 may contain different or additional devices than shown in the FIG. 2. For example, the top box may contain a bonus wheel or a back-lit silk screened panel which may be used to add bonus features to the game being played on the gaming machine. During a game, these devices are controlled and powered, in part, by a master gaming controller (not shown) housed within the main cabinet 4 of the machine 2. Understand that gaming machine 2 is but one example from a wide range of gaming machine designs on which the present invention may be implemented. For example, not all suitable gaming machines have top boxes or player tracking features. Further, some gaming machines have two or more game displays—mechanical and/or video, while others are designed for bar tables and have displays that face upwards. As another example, a game may be generated in on a host computer and may be displayed on a remote terminal or a remote computer. The remote computer may be connected to the host computer via a network of some type such as the Internet. Those of skill in the art will understand that the present invention, as described below, can be deployed on most any gaming machine now available or hereafter developed.

Returning to the example of FIG. 4, when a user selects a gaming machine 2, he or she inserts cash through the coin acceptor 28 or bill validator 30. Additionally, the bill validator may accept a printed ticket voucher which may be accepted by the bill validator 30 as an indicia of credit. As another example, the card reader may accept a debit card as the indicia of credit. The debit card, which may be an authentication instrument of the present invention, and the printed ticket voucher are examples of cashless instruments. Once cash has been excepted by the gaming machine, it may be used to play a game on the gaming machine. Typically, the player may use all or part of the cash entered into the gaming machine to make a wager on a game play. Depending on the amount of the wager on a game or for a fee, a player may be able to access various entertainment content sources for a length of time. For example, a wager on a game above a certain threshold amount may enable a player to watch a broadcast event or to access the World Wide Web for up to 5 minutes after each wager on the gaming machine 2. In addition, cash or indicia of credit entered into the gaming machine may be used to purchase entertainment content independent of a wager made on a game on the gaming machine. For example, for a 10 dollar fee, a player may view a movie on the gaming machine. This privilege may be stored on the authentication instrument. For instance, a player may pay $10 when the authentication instrument is issued for the privilege of being able to watch movies or have Internet services on the entertainment terminal or on gaming machine 2.

During the course of a game, a player may be required to make a number of decisions which affect the outcome of the game. For example, a player may vary his or her wager, select a prize, or make game-time decisions which affect the game play. These choices may be selected using the player-input switches 32, the main video display screen 34 or using some other device which enables a player to input information into the gaming machine including a key pad, a touch screen, a mouse, a joy stick, a microphone, a track ball or input devices connected to a entertainment terminal 226.

When a game is not being played on the gaming machine or during particular game operational modes, the player may select an entertainment content source using the above mentioned inputs where the entertainment content is independent of a game being played on the gaming machine. The entertainment content source may include, for instance, a CD player, an FM/AM tuner, a VHS player, a DVD player, a TV tuner, a musical jukebox, a video jukebox, a computer, a server and a media software application. It will be appreciated, however, that any information source may be utilized. Entertainment content from these sources may be selected and displayed on the entertainment terminal 226. For instance, a player may listen to music from the FM/AM tuner via headphones connected to the entertainment terminal.

Before playing a game, a player may select the video jukebox, which may contain a DVD player loaded with many DVDs, as the entertainment content source and preview a movie on at least one of the display screens on the gaming machine 2. The DVDs may be stored on the gaming machine 2 or in a central location separate from the gaming machine. The visual display of the output from the video jukebox may be viewed by the player on the main video display screen 34, the secondary video display screen 42 or the remote display 128. The sound for the movie may be projected by the speakers 10, 12 and 14 on the gaming machine or a player may listen to the movie through headphones. The entertainment terminal 226 may include an interface for audio output such as a headphone jack or speakers.

The game player may also use the player input switches 32, key pad 22, and other input devices to control a feature of the entertainment content. For example, when the entertainment content is a movie, the player input switches 32 and key pad may be operated to fast forward, stop or pause the movie. When the entertainment content is accessing the World Wide Web through a web-browser, the player input switches 32 and key pad may be used to operate the web-browser. Input switches, as described with respect to FIG. 2, on the entertainment terminal may also be used to control these functions.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18. When a player is using the entertainment terminal, credits available during the in-room game play session are stored on the gaming machine. When a player is finished playing an in-room game play session on gaming machine 2, credits left on the gaming machine may be stored to an authentication instrument or electronically transferred to a player account.

FIG. 5 is a flow chart depicting a method in a gaming machine of providing a game of chance on a remote entertainment terminal activated with an authentication instrument of the present invention. In 400, the gaming machine receives a request for game play from an entertainment terminal. In 405, the gaming machine validates the authentication instrument used to initiate the in-room game play session. In one embodiment, the gaming machine may contact an authentication server for approval before game play may begin. After approval of an in-room game play session, the gaming machine may configure itself and the entertainment terminal to allow the entertainment terminal to be used as a remote extension of the gaming machine. In some embodiments of the present invention, commands used to configure the gaming machine may be provided by the authentication server. For example, the authentication server may send a command to the gaming machine instructing it to configure itself to allow remote game play sessions.

In 410, credits are established on the gaming machine. In one embodiment, the authentication instrument may be used as a cashless instrument and the gaming machine may contact a cashless system server to transfer credits stored on the authentication instrument to the gaming machine. In another embodiment, the player may have an account or line of credit established with the casino which may be used to establish credits on the gaming machine. In 415, the gaming may receive a wager generated using the input devices connected to the entertainment terminal and adjust the credits on the gaming machine.

In one embodiment, the authentication instrument may include information regarding betting limits that may have been transmitted to the gaming machines. The gaming machine may check the current wager against any betting limits that it is tracking. When betting limits are exceeded, the gaming machine may display a message to the entertainment terminal indicating that betting limits have been exceeded and in some cases terminate the in-room game play session. For instance, an in-room game play session may be terminated when a session or daily betting limit has been exceeded.

In 420, the gaming machine may receive a request to initiate a game. In 425, the gaming machine may generate the game outcome. With the present invention, all regulated functions such as the calculation of a random number are generated on the gaming machine. These functions are not performed on the entertainment terminal. In 430, the gaming machine may display the game outcome to the entertainment terminal. For example, in a video slot game, reels may be shown spinning and then stopping at a particular position. In 435, the game outcome as part of a game history may stored to NV-RAM on the gaming machine. In 440, the gaming machine may determine if there is a bonus game. In 445, when there is a bonus game, the bonus game may be displayed on the entertainment terminal. In 450, the credits on the gaming machine may be adjusted for any credits won or credits lost. The credit information and any other status information may be displayed to the entertainment terminal.

FIG. 6 is a block diagram of a smart card for use as an authentication instrument of the present invention. The smart card 600 which may be the size of a magnetic striped card and may include an input/output interface 620, processor 610 memory 615 and battery 625 incorporated in some manner on a card substrate 605. The battery 625 is used to supply power to operate the devices on the smart card 600. In some embodiments, when it is inserted into a smart card reader of some type, power may also be supplied to the card by the smart card reader.

The smart card 600 may include an operating system of some type that is used to run applications on the smart card. In some embodiments, the operating system for the smart card 600 may be provided by Microsoft (Redmond, Wash.) or Sun Microsystems of Palo Alto, Calif. The operating system may be used to manage the execution of authentication instrument applications on the smart card. The operating system and gaming applications may incorporated into the processor 610 as firmware, stored in the memory 615 on the smart card or may be implemented as a combination of firmware in the processor 610 and stored in the memory 615. The processor 610 may be a general purpose microprocessor or a custom microcontroller incorporating gaming specific firmware. The memory 615 may be flash memory.

The Input/output interface 620 may be an I/O EEPROM that allows the smart card 100 to communicate with a smart card reader (see FIGS. 2 and 3) or some other communication interface residing on a gaming machine, a gaming peripheral, an entertainment terminal, a door access device or some other device designed to communicate with the smart card. Further, the I/O interface 620 may include one or more communication protocols that allow the smart card 600 to communicate with a gaming machine, gaming peripheral, entertainment terminal or some other device designed to communicate with the smart card. Some communication protocols may be stored in the memory 615 of the smart card 600. The communication protocols stored in the memory 615 may be added or deleted from the smart card 600 as needed.

The gaming applications incorporated into the smart card 600 and executed by the processor 610 may include but are not limited to bonus game applications, cashless instrument applications, progressive game applications, paytable applications and player tracking applications. In the bonus game application, when a game player inserts the smart card 600 into a gaming machine or an entertainment terminal and begins game play, game play information may be obtained by the smart card 600 from the gaming machine and stored in the memory 615 on the smart card. The game play information stored on the smart card 600 may be used to trigger a bonus game on the gaming machine.

When game play information is obtained by the smart card from the gaming machine, the game play information stored in the memory 615 of the smart card 600 may be updated as the player plays one or more games on the gaming machine. The game play information may include but is not limited to an amount wagered on each game, a time, a date and a game outcome for each game such as an award. The game play information may be stored on the smart card 600 in different categories. For instance, the game play information may be stored as generic game play information, which applies to all games, it may be stored as game specific play information, which applies to a specific game, or it may be stored as combinations of both generic game play information or game specific information.

Using the processor 610, the smart card 600 may operate on game play information as it is accumulated on the smart card. For instance, the smart card may store a running total of wager amounts made on the gaming machine for one or more games played while the smart card was inserted into the gaming machine during a game play sequence. This information may also be used to enforce betting limits. In addition, the game play information stored on the smart card 600 may be accumulated from one or more previous games played on one or more different gaming machines. For example, a running total of wager amounts stored on the smart card 600 may include the sum of an amount wagered over 5 games on a first gaming machine on a first day at a first location, the sum of an amount wagered over 10 games on a second gaming machine on a second day at a second location and the sum of an amount wagered on 15 games on a third gaming machine on a third day at a third location. Details of smart card applications that may be used with authentication instruments of the present invention are described in co-pending U.S. application Ser. No. 09/718,974, filed on Nov. 22, 2000, by Rowe, and entitled, "EZ Pay Smart Card and Ticket System," which is incorporated herein by reference and for all purposes.

Although the foregoing invention has been described in some detail for purposes of clarity of understanding, it will be apparent that certain changes and modifications may be practiced within the scope of the appended claims. For instance, while one of the gaming machines of this invention have been depicted as having top box mounted on top of the main gaming machine cabinet, the use of gaming devices in accordance with this invention is not so limited. For example, gaming machine may be provided without a top box.

What is claimed is:

1. A method of providing a game of chance, the method comprising:

in response to reading authentication instrument information from an authentication instrument in an entertainment terminal, wherein the entertainment terminal is located in a room, initiating a remote game play session on the entertainment terminal wherein the remote game play session comprises playing at least one game of chance using the entertainment terminal;

providing a communications link between the entertainment terminal and a gaming machine wherein the gaming machine is located on a casino floor outside of the room, the gaming machine operable to both:

i) provide the at least one game of chance in a local game play session in which the gaming machine is capable to receive a cash wager from a player located on the casino floor, including presentation of a game outcome on a display of the gaming machine responsive to receiving the wager, and output an award to the player, and ii) provide the at least one game of chance in the remote game play session;

the remote game play session including:

confirming approval for the remote game play session from an authentication server based on the authentication instrument information;

initiating the game of chance responsive to input from an input device connected to the entertainment terminal;

receiving at the entertainment terminal a game outcome from the gaming machine via the communications link, the game outcome generated on the gaming machine; and displaying the game outcome for the game of chance on the entertainment terminal.

2. The method of claim 1, wherein the game of chance is selected from the group consisting of slot games, poker, pachinko, multiple hand poker games, pai-gow poker, blackjack, keno, bingo, roulette, craps and card game.

3. The method of claim 1, wherein the authentication instrument is selected from the group consisting of a smart card, a magnetic striped card, an electronic token, a cell phone and a personal digital assistant.

4. The method of claim 1, wherein the authentication instrument information is a combination selected from the group consisting of 1) an authorization number that is used to approve the game play on the entertainment terminal, 2) a transaction number that is used for all games of chance initiated using the authentication instrument, 3) a betting limit, 4) a Personal Identification Number, 5) patron identification information, 6) player tracking information, 7) an expiration date, 8) a magnetic combination that is used to gain access to an entertainment terminal, 9) credits of indicia, 10) promotional credits used only for wagers in the game of chance, 11) one or more player preferences used to configure a gaming machine, 12) one or more encryption keys, 13) an authentication instrument identification number, 14) one or more gaming machine serial numbers, 15) biometric information, 16) an authorization number that is used to authorize sports wagering on the entertainment terminal, 18) an authorization number that is used to configure the authentication instrument to authorize a movie to be displayed on the entertainment terminal, 19) an authorization number that is used to configure the authentication instrument to authorize a video game of skill to be played on the entertainment terminal, 20) a magnetic combination that is used by a door access device to unlock a door, 21) a time and a date when the authentication instrument was issued and 22) a location where the authorization instrument was issued.

5. The method of claim 1, wherein access to the room is granted in response to reading the authentication instrument information from the authentication instrument in a door access device, and the authentication instrument information is read in the door access device from the authentication instrument using a magnetic striped card reader, a smart card reader, an electronic token acceptor and a wireless interface.

6. The method of claim 1, wherein the authentication instrument information is read in the entertainment terminal from the authentication instrument using a magnetic striped card reader, a smart card reader, an electronic token acceptor and a wireless interface.

7. The method of claim 1, wherein the confirming comprises:

sending a message requesting an approval for the remote game play session to the authentication server; and receiving the approval for the remote game play session from the authorization server.

8. The method of claim 1, wherein the confirming comprises:

sending a message requesting an authorization for the remote game play session to the authentication server;

receiving a rejection for the remote game play session from the authorization server; and terminating the remote game play session.

9. The method of claim 1, further comprising:

in response to reading authentication instrument information from the authentication instrument in the entertainment terminal, using the authentication information to determine a list of services available on the entertainment terminal;

displaying a menu of the determined services on the entertainment terminal.

10. The method of claim 1, further comprising;

storing game play session information to a non-volatile memory device located on the entertainment terminal.

11. The method of claim 1, further comprising:

receiving a wager for the game of chance.

12. The method of claim 1, further comprising:

displaying a bonus game on the entertainment terminal.

13. The method of claim 1, further comprising:

detecting the authentication instrument being removed from an authentication port in the entertainment terminal; and terminating the game play session.

14. The method of claim 1, further comprising:

receiving an input signal indicating a player dispute; and contacting a remote attendant station.

15. The method of claim 14, further comprising:

displaying game play history information to the entertainment terminal wherein the game play history information is used to resolve the dispute.

16. The method of claim 1, further comprising:

initiating a player tracking session for the games of chance played on the entertainment terminal.

17. The method of claim 1, further comprising:

configuring the entertainment terminal using commands transmitted from a remote device.

18. A method of providing a game of chance, the method comprising:

providing an entertainment terminal located in a room;

providing a gaining machine located on a casino floor separate from the room, the gaming machine operable to both:

i) provide at least one game of chance in a local game play session in which the gaming machine is capable to receive a cash wager from a player located on the casino floor, including presentation of a game outcome on a display of the gaming machine responsive to receiving the wager, and output an award to the player, and ii) provide the at least one game of chance in a remote game play session;

the remote game play session including:

providing a communications link between the entertainment terminal and the gaining machine;

reading authentication instrument information from an authentication instrument in the entertainment terminal;

initiating, responsive to reading the authentication instrument information, the remote game play session on the entertainment terminal, the remote game play session enabling play of the game of chance using the entertainment terminal;

confirming approval for the remote game play session from an authentication server based on the authentication instrument information;

initiating the game of chance responsive to input from an input device connected to the entertainment terminal;

receiving at the entertainment terminal a game outcome from the gaining machine via the communications link, the game outcome generated on the gaming machine; and displaying the game outcome for the game of chance on the entertainment terminal.

* * * * *